US007412194B2

(12) United States Patent
Okuda et al.

(10) Patent No.: US 7,412,194 B2
(45) Date of Patent: Aug. 12, 2008

(54) DEVELOPING APPARATUS

(75) Inventors: Akinobu Okuda, Osaka (JP); Kazumasa Hayashi, Hyogo (JP); Akinori Toyoda, Osaka (JP); Masao Ootsuka, Osaka (JP); Hideki Yasuda, Osaka (JP); Naoki Takahashi, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 329 days.

(21) Appl. No.: 11/410,193

(22) Filed: Apr. 25, 2006

(65) Prior Publication Data

US 2006/0239723 A1 Oct. 26, 2006

(30) Foreign Application Priority Data

Apr. 26, 2005 (JP) ..... 2005-127437

(51) Int. Cl.
*G03G 15/09* (2006.01)

(52) U.S. Cl. ..... 399/272; 399/277

(58) Field of Classification Search ..... 399/277, 399/256, 279, 272

See application file for complete search history.

(56) References Cited

U.S. PATENT DOCUMENTS 4,959,692 A * 9/1990 Hayashi et al. ..... 399/272
5,143,017 A * 9/1992 Haneda et al. ..... 399/256
5,151,739 A * 9/1992 Hediger ..... 399/256

FOREIGN PATENT DOCUMENTS

JP 11-065247 3/1999
JP 2001-356545 12/2001

OTHER PUBLICATIONS

English Language Abstract of JP 2001-356545.
English Language Abstract of JP 11-065247.

* cited by examiner

*Primary Examiner*—Susan S Lee
(74) *Attorney, Agent, or Firm*—Greenblum & Bernstein, P.L.C.

(57) ABSTRACT

The present invention provides a developing apparatus that can effectively prevent generation of a ghost due to poor detachment of a developer after development, and generation of unevenness in density between a left part and a right part of an image region due to lack of an amount of the developer transported. The developing apparatus satisfies the relationship $$r+R \leqq d \leqq 3r+R$$

where r denotes a rotational radius of a second developer transporting screw, R denotes a rotational radius of a development roller, and d denotes a center distance between the second developer transporting screw and the development roller. The developing apparatus also satisfies the relationship $$M0 \geqq (mg0 \times v \times l)/0.02$$

where mg0 (g/mm$^2$) denotes an amount of a toner per unit area that is supplied from the development roller to an electrostatic latent image having 100% image coverage which is formed on a photosensitive drum, v (mm/s) denotes a rotational peripheral velocity of the photosensitive drum, l (mm) denotes a maximum printing width on the photosensitive drum, and M0 (g/s) denotes an amount of the developer transported per unit time by the second developer transporting screw in a second developer transport direction.

10 Claims, 12 Drawing Sheets

DEVELOPING APPARATUS

CROSS-REFERENCE TO RELATED APPLICATIONS

The present disclosure relates to subject matter contained in priority Japanese Application No. 2005-127437, filed on Apr. 26, 2005, which is herein expressly incorporated by reference in its entirety.

BACKGROUND OF THE INVENTION

1. Field of the Invention

The present invention relates to a developing apparatus used for developing an electrostatic latent image that is formed on an electrostatic latent image bearing member in an image forming apparatus such as a copier, a printer, a facsimile and the like.

2. Description of Related Art

Conventionally, an electrophotographic image forming apparatus, which optically scans an original image portion that is supported on an outer circumferential surface of a uniformly electrified photosensitive drum (an electrostatic latent image bearing member) so as to form an electrostatic latent image, and converts the electrostatic latent image into a visible image by using a toner, that can be a colored resin, is known. Such an image forming apparatus is capable of forming an image at a high speed, and thus has been used widely for digital printers, copiers and the like.

In recent years, there have been increasing demands on such apparatuses, particularly for forming color images. As electrophotographic image forming apparatuses, apparatuses for forming full color images composed of toner images of four colors: yellow (Y); magenta (M); cyan (C); and black (Bk) also have been available. In particular, tandem type image forming apparatuses that are advantageous for high-speed printing have been widely used, and they are becoming more and more mainstream.

This type of tandem type image forming apparatus includes image forming units for each of four colors that are disposed in parallel, and thus gives rise to a problem that the size of the apparatus increases. In order to solve this problem, a configuration in which a spacing or a pitch between photosensitive drums that are adjacent to each other is shortened in an image forming apparatus of a non-magnetic one-component developing system using a developer that contains only a toner has been proposed so as to decrease the size of the apparatus (see, for example, JP 2001-356545 A). In such a configuration, a development roller that develops an electrostatic latent image by allowing a toner to adhere onto a circumferential surface of the photosensitive drum is disposed above a cleaning member of an upstream adjacently positioned photosensitive drum, thereby shortening the pitch or distance between the adjacent photosensitive drums so as to decrease the overall size of the apparatus. That is, this configuration provides a narrow-pitch image forming system.

Generally, as the developing system, a two-component developing system using a developer containing a toner and a magnetic carrier that can provide high image quality and low operating costs has been widely used, in addition to the non-magnetic one-component developing system. In the two-component developing system, the developer is rubbed against a surface of the photosensitive drum with a magnetic brush by using the development roller that is provided with a development sleeve having magnets disposed therein and carries the developer. Only the toner is transferred onto the surface of the photosensitive drum, thus developing the electrostatic latent image.

In order to satisfy all of the demands for a decrease in size, high image quality and low operating costs, which have been further become more stringent recently, the present inventors have developed an image forming apparatus in which a narrow-pitch image forming system is provided with a two-component developing system.

In the two-component developing system, detaching the developer that is attached on the surface of the development roller after the development is important, and if the detachment of the developer, after development, is not sufficient, a toner density of the developer at a part where the toner is consumed and a toner density where the toner is not consumed are different, which may cause generation of unevenness of density, which is called a "ghost (or memory)" image. Generally, such detachment of a developer is performed by: providing an odd number of magnets in the development roller; disposing a pair of magnets having a same pole in a position below a shaft center (a rotational center line) of the development roller so as to provide a detaching region where a magnetic force is substantially zero; and dropping the developer, after development, by free-fall using gravity in this region. Then, the detached developer is transported by a developer transporting screw that is disposed near the detaching region, and is adjusted to have a predetermined toner density again by being circulated in the developing apparatus.

However, in the narrow-pitch image forming system in which the development roller is positioned above the cleaning member of the upstream adjacently positioned photosensitive drum, since the cleaning member of the upstream adjacently positioned photosensitive drum is positioned below and close to the development roller, the detaching region of the developer, where the pair of magnets of the same polarity are disposed is inevitably positioned above the shaft center (the rotational center line) of the development roller. As a result, the detachment of the developer using gravity cannot be achieved, which may cause generation of the unevenness in density which can give rise to the above-noted "ghost".

In order to solve this problem, a configuration where a drawing-up roller having a magnet therein is disposed near the detaching region on the development roller, and the developer, after development, is detached by a magnetic force of the magnet has been proposed (see, for example, JP 11-65247 A). In this case, the detached developer is drawn up (or taken up) by another drawing-up roller, and thereafter is transported to a developer stirring chamber having a screw, where the toner density is adjusted again and the toner is electrified.

However, in the above-discussed configuration where the detaching region of the developer, in which the pair of magnets of the same polarity are disposed, is positioned above the shaft center (the rotational center line) of the development roller, when the developer, after development, is detached by using the drawing-up roller having the magnet therein as described in JP 11-65247 A, the developer stirring chamber or the like for stirring the developer must be provided separately. Thus, a problem arises in that the developing apparatus is complicated in configuration and has a large size. In addition, the magnet is required to be disposed in the drawing-up roller, which may increase manufacturing costs and a weight of the apparatus.

SUMMARY OF THE INVENTION

Therefore, with the foregoing in mind, it is an object of the present invention to solve at least the above-described problem in the prior art, and to provide a developing apparatus that can provide high image quality, a small size, a light weight and low costs, which can effectively prevent the generation of the ghost due to the poor detachment of the developer, after development. The present invention also provides a developing apparatus which prevents the generation of the unevenness in density between a left part and a right part of an image region due to lack of an adequate amount of the developer transported, and can circulate the developer smoothly, without using the drawing-up roller or the like having the magnet therein, even in a configuration where the detaching region of the developer in which the pair of magnets of the same polarity are disposed is positioned above the shaft center (the rotational center line) of the development roller, such as the narrow-pitch image forming system that utilizes the two-component developing system.

In order to attain the above-described object, the configuration of the developing apparatus according to the present invention includes: a rotatable development roller that supplies a two-component developer containing a toner and a carrier to a rotatable electrostatic latent image bearing member having an electrostatic latent image formed on a surface, and converts the electrostatic latent image into a visible image; a stationary magnet roller that is provided in the development roller, includes a development main pole and at least a pair of magnetic poles of the same polarity for detaching the developer, and has a midpoint between the magnetic poles of the same polarity on the development roller that is positioned above a rotation shaft of the development roller; a first developer transport path and a second developer transport path that extend in parallel to the development roller; a first developer transporter that is mounted for rotation in the first developer transport path, and transports the two-component developer in a first developer transport direction by rotation; and a second developer transporter that is disposed in the second developer transport path, has a rotation shaft positioned above the rotation shaft of the development roller, transports the two-component developer in a second developer transport direction which is opposite to the first developer transport direction by rotation, supplies the two-component developer to the development roller and detaches the two-component developer from the development roller. A relationship $$r+R \leqq d \leqq 3r+R \quad \text{(Formula 1)}$$

is satisfied, where r (mm) denotes a rotational radius of the second developer transporter, R (mm) denotes a rotational radius of the development roller, and d (mm) denotes a center distance between the second developer transporter and the development roller, and a relationship $$M0 \geqq (mg0 \times v \times 1)/0.02 \quad \text{(Formula 2)}$$

is satisfied, where mg0 (g/mm$^2$) denotes an amount of the toner per unit area that is supplied from the development roller to an electrostatic latent image having 100% image coverage which is provided on the electrostatic latent image bearing member, v (mm/s) denotes a rotational peripheral velocity of the electrostatic latent image bearing member, l (mm) denotes a maximum printing width of the electrostatic latent image bearing member, and M0 (g/s) denotes an amount of the developer transported per unit time by the second developer transporter in the second developer transport direction.

According to the configuration of the developing apparatus of the present invention, since a strong flow of the developer is provided near the detaching region, and stagnation of the developer near the detaching region is prevented, the developer, after development, that is detached once in the detaching region can be prevented from adhering to the development roller again. Moreover, by taking the developer that has a weakened magnetic binding force applied to the development roller near the detaching region into the above-described flow of the developer, detachability of the developer can be improved. At the same time, as a result of the strong flow of the developer, the developer that is detached from the development roller can be swiftly replaced with the developer that is transported from the first developer transporter, and the inclination of the toner density generated in the developer transport direction can be suppressed.

As a result, a developing apparatus having a small size and a simple configuration, which can effectively prevent the generation of the ghost due to the poor detachment of the developer, after development, and the generation of the unevenness in density between the left part and the right part of an image region due to the lack of an adequate amount of the developer transported, can be provided.

In the configuration of the developing apparatus according to the present invention, it is preferable that a relationship of $$1.3r+R \leqq d \leqq 2r+R \quad \text{(Formula 3)}$$

is satisfied.

According to this preferable example, by setting the center distance d to be not less than 1.3r+R, unevenness of a pressure applied to the developer by the developer transporter is decreased, and thus the uniformity of the image density can be ensured. Moreover, by maintaining the center distance d to be not more than 2r+R, the developer near the detaching region that has the weakened magnetic binding force applied to the development roller is taken into the above-described flow of the developer more efficiently, whereby the detachability of the developer can be further improved.

As a result, the developing apparatus having a small size and a simple configuration, which can more effectively prevent the generation of the ghost due to the poor detachment of the developer, after development, can be provided.

Moreover, in the configuration of the developing apparatus according to the present invention, it is preferable that the second developer transport path is disposed below the first developer transport path, and the developing apparatus further includes: two communicating holes, one at each end of the first developer transport path and the second developer transport path so that the first developer transport path and the second developer transport path communicate with each other; and a developer drawing-up unit provided near one of the communicating holes, and draws up the two-component developer which is transported in the second developer transport path into the first developer transport path.

According to this preferable example, since the first developer transport path and the second developer transport path are disposed above and below each other, a developing apparatus with a small horizontal width can be realized. Moreover, by applying the development apparatus with this configuration to a tandem type image forming apparatus, a pitch or a spacing between image forming units that are adjacent to each other can be shortened, thus decreasing a size of the image forming apparatus.

Moreover, according to this preferable example, since the developer drawing-up unit, that draws up the developer transported in the second developer transport path, which is positioned on a lower side, into the first developer transport path, which is positioned on an upper side, is included, the developer can be circulated smoothly between the first developer transport path and the second developer transport path. Thus, accumulation and clogging of the developer at the end of the second developer transport path and the unevenness of the image density on the edge of the image region, deterioration of the developer and the like that are caused thereby can be prevented effectively.

Furthermore, in this case, it is preferable that an amount of the developer drawn up per unit time by the developer drawing-up unit from the second developer transport path into the first developer transport path is not less than the amount of the developer transported per unit time by the second developer transporter in the second developer transport direction, and a transporting speed of the two-component developer transported by the second developer transporter in the second developer transport direction is more than a transporting speed of the two-component developer transported by the first developer transporter in the first developer transport direction.

According to this preferable example, by setting the amount of the developer drawn up per unit time by the developer drawing-up unit to be not less than the amount of the developer transported per unit time by the second developer transporter, the accumulation and the clogging of the developer at the end of the second developer transport path and the unevenness of the image density on the edge of the image region, the deterioration of the developer and the like that are caused thereby can be prevented effectively.

Moreover, according to this preferable example, by setting the transporting speed of the developer transported by the second developer transporter to be more than the transporting speed of the developer transported by the first developer transporter, since the developer can be mixed and stirred, thus spending a sufficient period of time in the first developer transporter, an appropriate and uniform toner density can be ensured, and a sufficiently electrified toner can be supplied to the second developer transporter. By increasing the transporting speed of the developer transported by the second developer transporter, the developer, after development, that is transported from the development roller can be swiftly replaced with the developer that is supplied from the first developer transporter.

As a result, a developing apparatus which can circulate the developer smoothly between the first developer transport path and the second developer transport path, and can effectively prevent a fog that is caused by splashing of the toner and adhesion of the toner to a non-image portion due to lack of an adequate electric charge of the toner is provided. Thus also the unevenness in density due to the lack of the toner during the development can be prevented.

Moreover, in this case, it is preferable that a cross-sectional open area of the first developer transport path enclosing the developer drawing-up unit and the first developer transporter that is positioned in a vicinity of the developer drawing-up unit is larger than a cross-sectional open area of the first developer transport path enclosing the first developer transporter except for the vicinity of the developer drawing-up unit.

According to this preferable example, in the vicinity of the developer drawing-up unit in the first developer transport path, a space which is sufficient to receive the developer that is transported by the second developer transporter can be provided. As a result, the accumulation and the clogging of the developer at the end of the second developer transport path that is positioned below the developer drawing-up unit and the unevenness of the image density on the edge of the image region, the deterioration of the developer and the like that are caused thereby can be prevented effectively, and the developer can be circulated smoothly.

Moreover, in the configuration of the developing apparatus according to the present invention, it is preferable that a transporting speed of the two-component developer transported by the second developer transporter in the second developer transport direction is more than a transporting speed of the two-component developer transported by the first developer transporter in the first developer transport direction.

According to this preferable example, by setting the transporting speed of the developer transported by the second developer transporter to be greater than the transporting speed of the developer transported by the first developer transporter, since the developer can be mixed and stirred, and spends a sufficient period of time in the first developer transporter, an appropriate and uniform toner density can be achieved, and a sufficiently electrified toner can be supplied to the second developer transporter. By increasing the transporting speed of the developer transported by the second developer transporter, a developer, after development, that is transported from the development roller, can be swiftly replaced with a developer that is supplied from the first developer transporter.

As a result, the developing apparatus which can effectively prevent the fog that is caused by the splashing of the toner and the adhesion of the toner to the non-image portion due to the lack of adequate electric charge of the toner is provided. Also, unevenness in density due to the lack of the toner during the development can be prevented.

Moreover, in the configuration of the developing apparatus according to the present invention, it is preferable that volume resistivity of the carrier in an electric field of 2 kV/cm is not more than $1\times10^{10}$ Ω·cm.

According to this preferable example, since the electric charge that is generated due to frictional charging with the toner is not accumulated in the carrier, an image force of the carrier applied to the development roller is decreased, and the detachability of the developer is improved. At the same time, since the image forces of the carrier applied to the respective members in the developing apparatus, except the development roller, such as developer transporting screws and an inner wall of the developing apparatus, are decreased, and aggregation and stagnation of the developer near the respective members are prevented, the developer can be transported, mixed and stirred smoothly, and the inclination of the toner density generated in the developer transport direction can be suppressed.

Moreover, in the configuration of the developing apparatus according to the present invention, it is preferable that the carrier is a resin carrier obtained by dispersing a magnetic material in a thermosetting resin as a binder resin.

According to this preferable example, sphericity of the carrier and smoothness of a surface thereof are improved, and the fluidity and the detachability of the developer are improved. As a result, the adhesion of the developer to the development roller is decreased, and the detachability of the developer from the development roller is significantly improved. Furthermore, by the improvement of the fluidity of the carrier, the developer can be transported, mixed and stirred smoothly, and the inclination of the toner density generated in the developer transport direction can be suppressed.

Moreover, in the configuration of the developing apparatus according to the present invention, it is preferable that a shape factor, a SF value, of the toner ranges between about 100 and 140 inclusively.

According to this preferable example, the sphericity of the toner is increased, and the fluidity of the toner is improved. Due to the improvement, in addition to the high fluidity of the carrier, the fluidity of the developer is further improved. As a result, the detachability of the developer from the development roller can be further improved. Furthermore, due to the improvement of the fluidity of the developer, the developer can be transported, mixed and stirred smoothly, and the inclination of the toner density generated in the developer transport direction can be suppressed.

In addition, due to the high fluidity of the toner, the coating agent on the surface of the carrier can be prevented from being worn away, and thus the high fluidity of the developer can be maintained over a long period of time.

Moreover, in the configuration of the developing apparatus according to the present invention, it is preferable that the toner contains, as a lubricator, at least one selected from the group consisting of metallic soaps of zinc stearate, calcium stearate, aluminum stearate and magnesium stearate.

According to this preferable example, since the toner functions as a lubricant, and the fluidity of the developer is further improved, the detachability of the developer from the development roller can be further improved. Furthermore, by the improvement of the fluidity of the developer, the developer can be transported, mixed and stirred smoothly, and the inclination of the toner density generated in the developer transport direction can be suppressed.

In addition, due to the function of the toner as a lubricant, a soft contact of the toner with the carrier can be achieved, whereby the coating agent on the surface of the carrier can be prevented from being worn away, and the high fluidity of the developer can be maintained over a long period of time.

The present invention can effectively prevent the generation of the ghost due to the poor detachment of the developer, after development, and the generation of unevenness in density between the left part and the right part of the image region due to an inadequate amount of a developer transported, and can circulate the developer smoothly, by a small-sized and simple structure without using the drawing-up roller or the like having the magnet therein, even with the configuration where the detaching region of the developer in which the pair of magnets of the same polarity are disposed is positioned above the shaft center (the rotational center line) of the development roller, such as the narrow-pitch image forming system utilizing the two-component developing system.

These and other advantages of the present invention will become apparent to those skilled in the art upon reading and understanding the following detailed description with reference to the accompanying figures.

BRIEF DESCRIPTION OF THE DRAWINGS

The above, and other objects, features and advantages of the present invention will be made apparent from the following description of the preferred embodiments, given as non-limiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description when taken with the drawings making apparent to those skilled in the art how the forms, features and aspects of the present invention may be embodied in practice.

The embodiments of the present invention are explained in detail in the following with reference to the above-described drawings. FIGS. 1 through 9 illustrate a first embodiment of the present invention.

The present invention will be described more specifically below, by way of the various embodiments.

Embodiment 1

Figure 1:
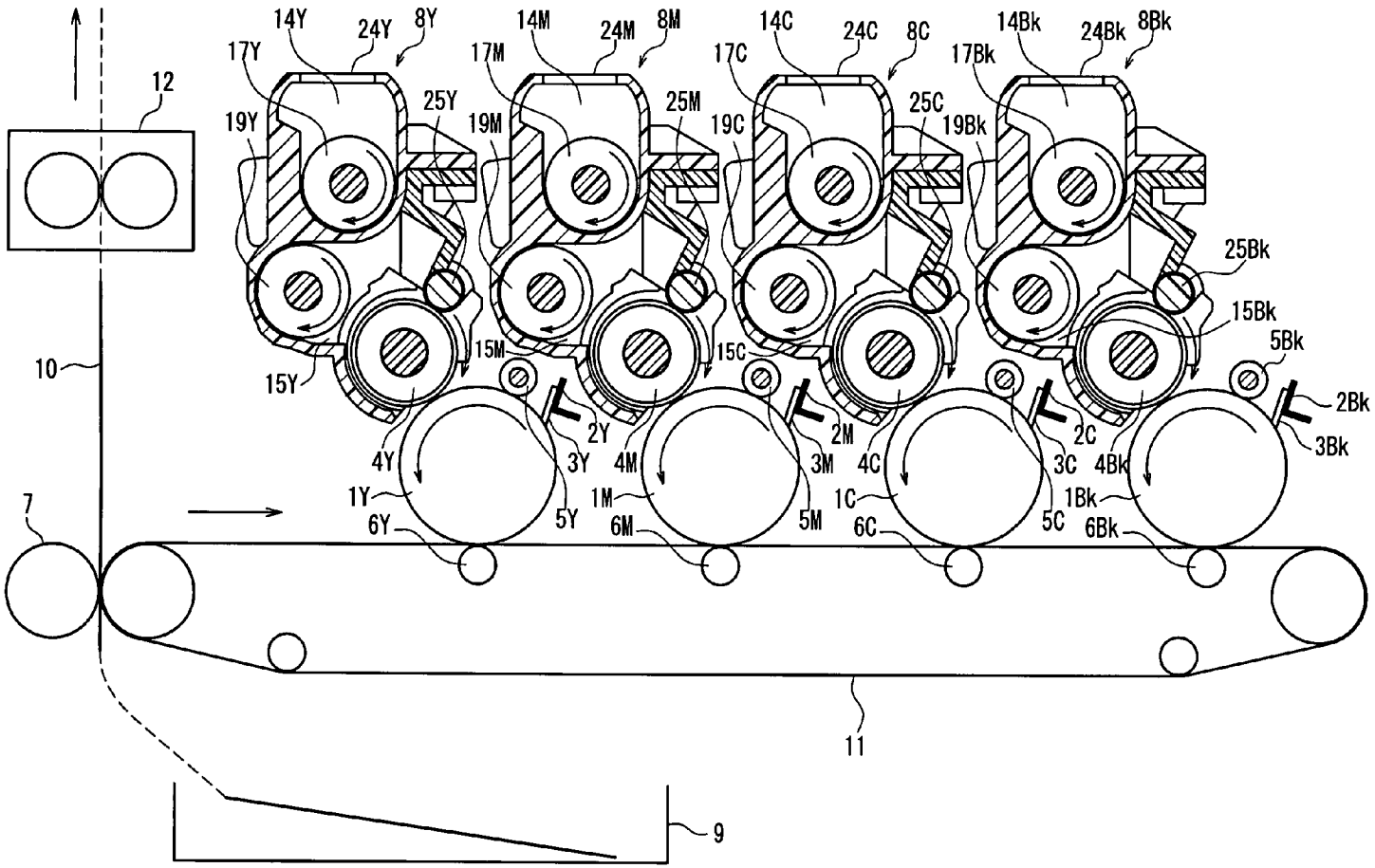
FIG. 1 is a cross-sectional view schematically showing a configuration of an entire image forming apparatus according to Embodiment 1 of the present invention.
Figure 2:
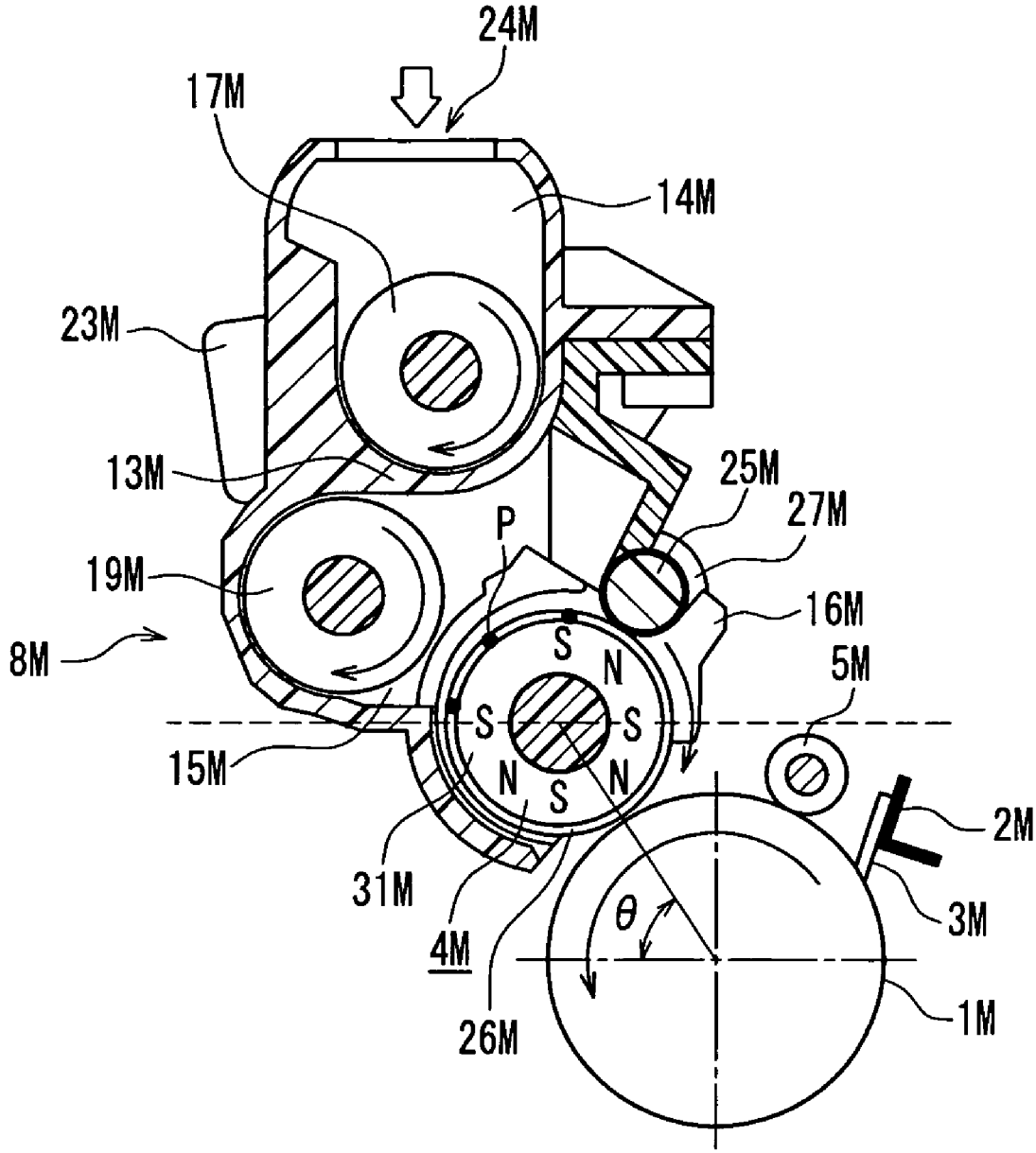
FIG. 2 is a cross-sectional view schematically showing a relevant part of an image forming unit according to Embodiment of the present invention.
Figure 3:
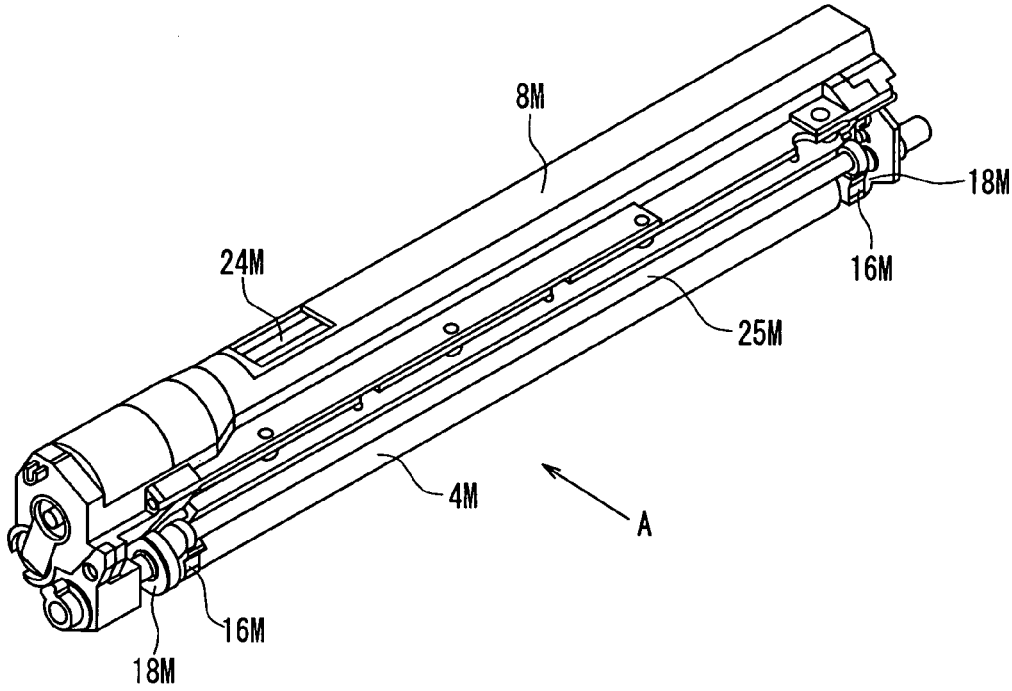
FIG. 3 is an external perspective view showing a developing apparatus according to Embodiment 1 of the present invention.
Figure 4:
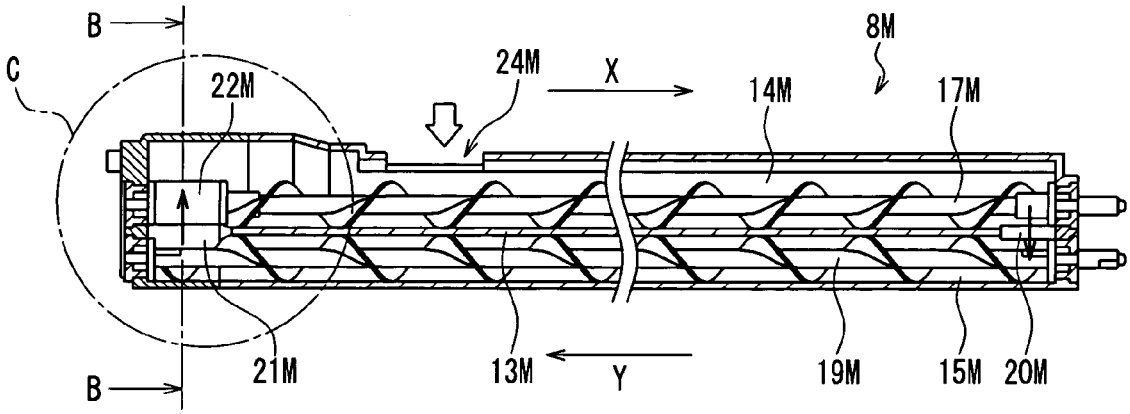
FIG. 4 is a cross-sectional view showing a relevant part of the developing apparatus of FIG. 3, seen from the direction of arrow A in FIG. 3.
Figure 5:
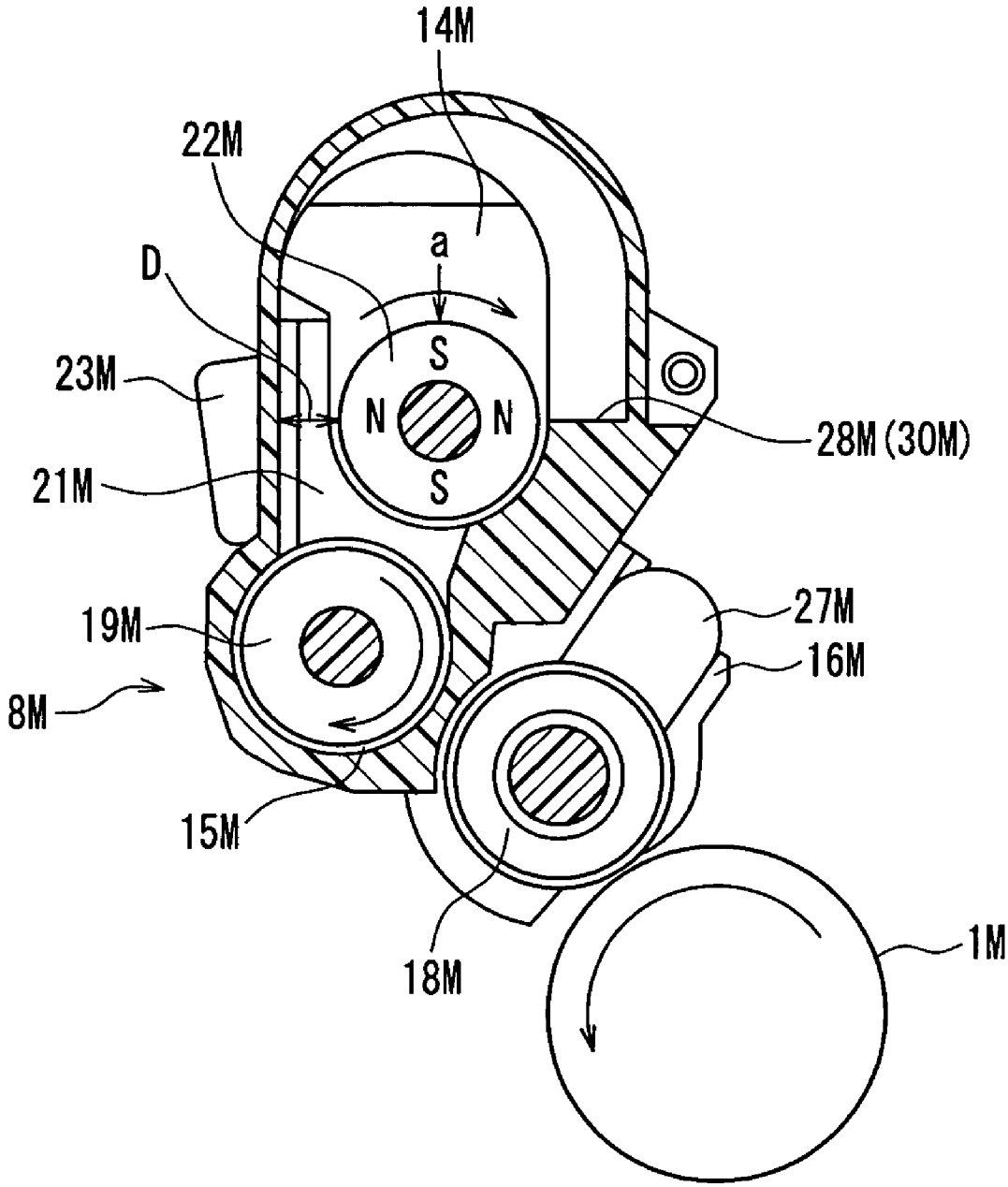
FIG. 5 is a cross-sectional view taken along line B-B of FIG. 4.
Figure 6A:
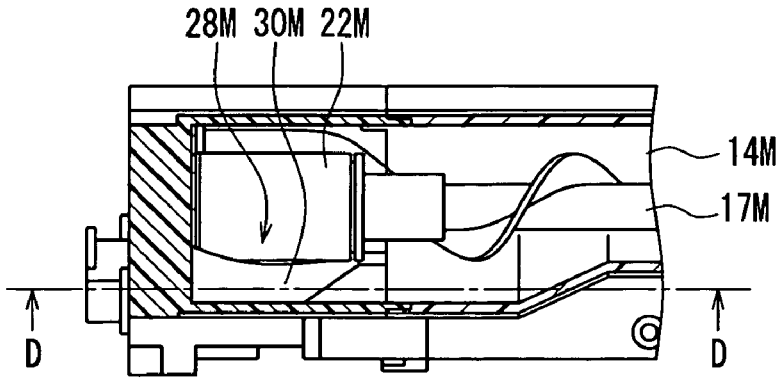
FIG. 6A is an enlarged view showing a part C of FIG. 4.
Figure 6B:
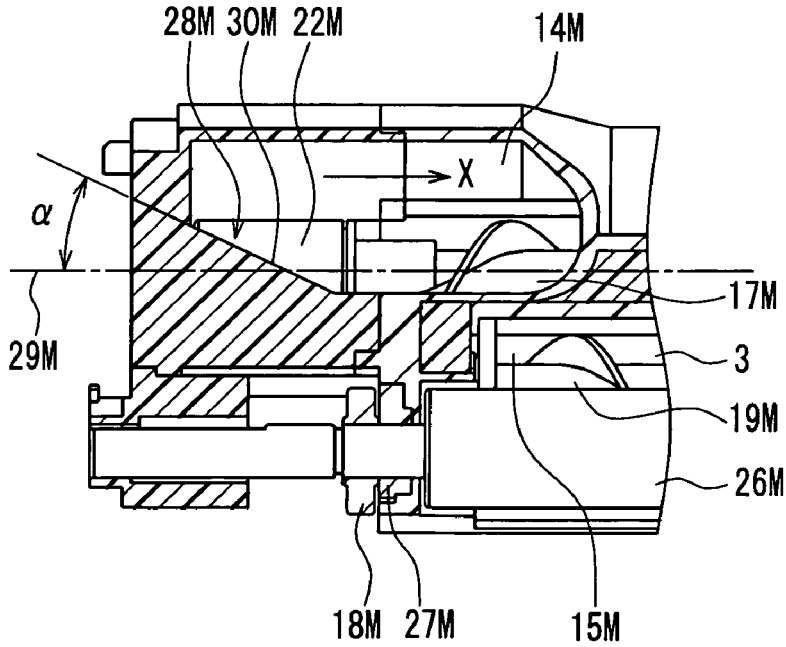
FIG. 6B is a cross-sectional view taken along line D-D of FIG. 6A.
Figure 7:
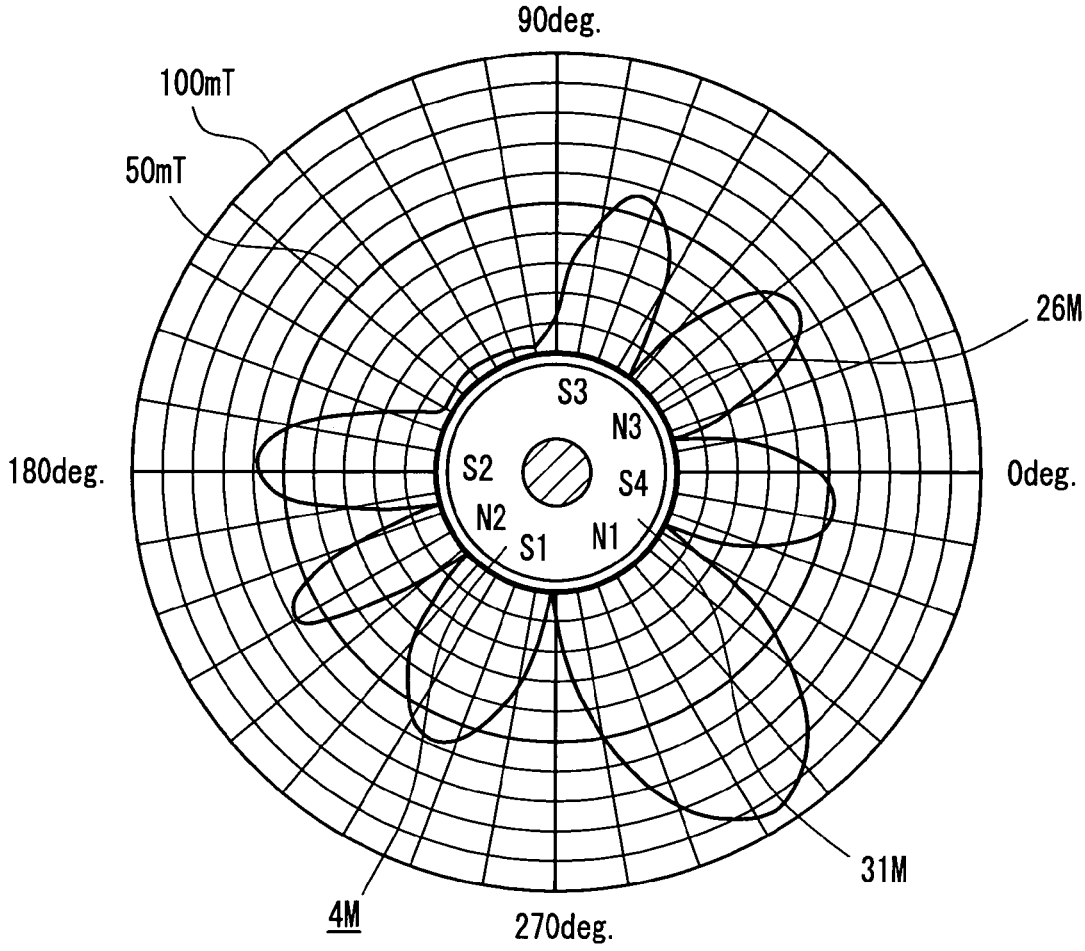
FIG. 7 is a chart showing magnetic pole arrangement and a distribution of magnetic flux density in a development roller according to Embodiment 1 of the present invention.

FIG. 1 is a cross-sectional view schematically showing a configuration of an entire image forming apparatus according to Embodiment 1 of the present invention, and FIG. 2 is a cross-sectional view schematically showing a relevant part of an image forming unit according to Embodiment of the present invention. FIG. 3 is an external perspective view showing a developing apparatus according to Embodiment 1 of the present invention, and FIG. 4 is a cross-sectional view showing a relevant part of the developing apparatus of FIG. 3, seen from the direction of arrow A. FIG. 5 is a cross-sectional view taken along line B-B of FIG. 4, FIG. 6A is an enlarged view showing a part C of FIG. 4, and FIG. 6B is a cross-sectional view taken along line D-D of FIG. 6A. FIG. 7 is a chart or a graph showing magnetic pole arrangement and a distribution of magnetic flux density in a development roller according to Embodiment 1 of the present invention. In FIG. 5, a photosensitive drum that is omitted from being shown in FIGS. 3 and 4 is also shown.

Initially, a configuration of the entire image forming apparatus according to the present embodiment will be briefly described with reference to FIG. 1.

As shown in FIG. 1, in the image forming apparatus of the present embodiment, four image forming units (process cartridges) that respectively are provided with the developing apparatuses and photosensitive drums as electrostatic latent image bearing members are arranged in the order of yellow (Y), magenta (M), cyan (C) and black (Bk). That is, the image forming apparatus of the present embodiment is a color image forming apparatus of a tandem type (i.e., one-pass type), in which the image forming units of the four colors are disposed in parallel, has a processing speed of 150 mm/s, is capable of printing about 24 A4 size recording sheets per minute, and can provide a full-color print image. Further, in the image forming apparatus of the present embodiment, between the photosensitive drum 1Y of yellow and the photosensitive drum 1M of magenta, a cleaning blade 3Y that is held by a support 2Y, and removes a toner remaining on a surface of the photosensitive drum 1Y by contacting a circumferential surface of the upstream-sided photosensitive drum 1Y is provided. In addition, a development roller 4M for allowing a toner to adhere onto the circumferential surface of the downstream-sided photosensitive drum 1M is positioned so that a shaft center (a rotational center line) thereof is above the support 2Y, and may be positioned on a line segment connecting: a shaft center (a rotational center line) of the upstream-sided photosensitive drum 1Y; and the support 2Y. That is, the development roller 4M is positioned above the cleaning blade 3Y of the upstream adjacently positioned photosensitive drum 1Y. Moreover, the corresponding members of the other colors are similarly positioned. As one result of such a configuration, a spacing or a pitch between the adjacent photosensitive drums can be shorten, whereby a size of the image forming apparatus can be decreased.

A configuration of the image forming unit will be described below, using, as an example, the magenta image forming unit. Since the image forming units of the other colors have the same configuration as that of magenta image forming unit, the description of the other units will be omitted. The photosensitive drum 1M is a photoreceptor (an organic layered photoreceptor) that is made of a suitable material such as a layered organic material, and has an appropriate outer diameter such as 24 mm, has an appropriate maximum printing width l such as 200 mm, and rotates at a suitable peripheral velocity v such as 150 mm/s. The image forming unit is provided with: an electrifying roller 5M that electrifies the photosensitive drum 1M while rotating in accordance with the rotation of the photosensitive drum 1M; and a primary transfer roller 6M that transfers a toner image formed on the photosensitive drum 1M onto an intermediate transfer belt 11. The electrifying roller 5M is formed of a suitable material such as, for example, an epichlorohydrin rubber provided around a metal shaft, and can have an appropriate outer diameter such as, for example, 10 mm. The primary transfer roller 6M can be formed of a suitable material such as, for example, a conductive urethane sponge provided around a metal shaft, and has an appropriate outer diameter thereof such as, for example, 12 mm. As the intermediate transfer belt 11, an appropriate material such as, for example, polycarbonate sheet with volume resistivity of $1\times10^9$ Ω·cm can be used.

The surface of the photosensitive drum 1M that is uniformly electrified by the electrifying roller 5M is irradiated with a laser beam (not shown in the figure) in accordance with image information, thereby forming an electrostatic latent image on the drum. Further, a magnetic brush of a developer that is transported to a development region (a region between the development roller 4M and the photosensitive drum 1M) by the development roller 4M is rubbed against the electrostatic latent image, and only a toner is transferred onto the surface of the photosensitive drum 1M, thereby forming a toner image on the photosensitive drum 1M. Herein, a laser power is set to an appropriate value (a value on the surface of the photosensitive drum 1M) such as 295 μW, and an appropriate DC voltage such as −1.05 kV is applied to the electrifying roller 5M. An electrification potential V0 and a potential VL after the exposure of the photosensitive drum 1M were measured, and they were −500 V and −50 V, respectively. Moreover, a bias voltage is applied to the development roller 4M. For the bias voltage to be applied to the development roller 4M, it is preferable to set the DC voltage to be in an appropriate range such as from −100 V to −650 V while adjusting the image density and the like as necessary. Moreover, in order to promote the movement of the toner, an AC voltage of a rectangular wave or a sine wave with a frequency in an appropriate range such as from about 1 kHz to about 6 kHz, and an amplitude in an appropriate range such as from about 0.2 kV to about 10 kV, is preferably applied. Furthermore, by the application of the AC voltage, a required image density can be obtained, the toner can be prevented from adhering to a non-image portion of the drum, and reproducibility of microdots can be enhanced. In the present embodiment, a bias voltage in which an AC voltage of a rectangular wave with a frequency of 5 kHz and a peak-to-peak value of 1.3 kV superimposed with a DC voltage of −350 V is applied.

The toner image formed on the photosensitive drum 1M is transferred onto a surface of the intermediate transfer belt 11 by the primary transfer roller 6M to which a voltage of +600 V is applied.

The above-described operational processes are carried out for each of the image forming units of yellow, magenta, cyan, and black, which are provided with a developing apparatus 8Y (8M, 8C, 8Bk) and a photosensitive drum 1Y (1M, 1C, 1Bk), thereby forming a four-color synthesized toner image on the intermediate transfer belt 11. Thereafter, the synthesized toner image is collectively transferred by a secondary transfer roller 7 onto a recording sheet 10 that is transported from a recording sheet tray 9, and is fixed onto a surface of the recording sheet 10 by suitable mechanisms such as heat, pressure and the like, using a fixing device 12 provided along a discharge path of the recording sheet 10.

The toner remaining on the surface of the photosensitive drum 1M after the completion of the transfer of the toner image onto the intermediate transfer belt 11 is removed by a cleaning blade 3M that is prepared by a suitable method such as by shaping an urethane rubber in a sheet, thereby completing a cycle of the image formation.

The configuration of the developing apparatus of the present embodiment will be described further in detail using the developing apparatus 8M for magenta, with reference to FIGS. 2 to 7. The description below is applicable also to the developing apparatuses 8Y, 8C and 8Bk of the other colors.

The developing apparatus 8M of the present embodiment includes a development housing obtained by mixing glass with an appropriate resin material such as polycarbonate (PC) and acrylonitrile-butadiene-styrene (ABS). As shown in FIGS. 2 and 4, this developing apparatus 8M is divided into two developer transport paths by a partition wall 13M. More specifically, the development housing includes: a first developer transport path 14M that is positioned above the partition wall 13M and at a larger distance from the development roller 4M; and a second developer transport path 15M that is positioned below the partition wall 13M and at a smaller distance from the development roller 4M.

As shown in FIGS. 2 and 3, a projecting portion 16M projecting from a portion where a below-described second developer transporting screw 19M is disposed, toward the photosensitive drum 1M side is formed in the second developer transport path 15M, and the development roller 4M and a doctor blade 25M are rotatably positioned at a constant or fixed interval or spacing by this projecting portion 16M.

The development roller 4M includes a stationary magnet roller 31M in which seven magnets are fixed and arranged in a development sleeve 26M with an appropriate surface roughness Rz such as 5 μm. The development roller serves as a developer bearing member, which is rotatable and made of a suitable material such as aluminum. This development roller 4M transports the magnetic brush or layer of the developer that is adjusted to have a constant length (i.e., distance extending away from the sleeve) by a doctor blade 25M to the development region by the rotation of the development sleeve 26M. The seven magnets in the development sleeve 26M are arranged and positioned so that a peak (or maximum) of the magnetic force may be formed in the development region where the development roller 4M and the photosensitive drum 1M are close to each other, and a valley (or minimum) of the magnetic force may be formed near the doctor blade 25M. In the present embodiment, a north pole of a magnet is disposed in the development region so as to set a main pole magnetic force to be 95 mT, and the doctor blade 25M is sandwiched between a south pole of a magnet and a north pole of a magnet. Moreover, in a region of the development roller 4M close to the second developer transport path 15M, a region where a magnetic force is substantially zero (a detaching region P) is provided by disposing a pair of south poles of a magnets so as to be close to each other, for the purpose of effectively detaching the developer, after development. In order to allow the magnetic force in this detaching region P to be closer to zero, a distance between the magnets with the same pole must be larger. The magnetic force in the detaching region P (a value on a surface of the development sleeve 26M) was measured with a gauss meter (HGM8900: manufactured by TOYO JIKI INDUSTRY CO., LTD.), it was found to be a low magnetic force of 5 mT or less.

The distribution of the magnetic flux density of the development roller 4M, and a peak of the magnetic force, an arrangement angle (related to a radial position of the flux density) and a central angle of each of the magnets of the present embodiment are shown in FIG. 7 and Table 1 below.

TABLE 1

| Magnet | Peak of magnetic force (mT) | Arrangement angle (deg.) | Central angle (deg.) |
|---|---|---|---|
| S4 | 52.7 | −5.9 | 30.9 |
| N3 | 54.5 | 36.9 | 26.9 |
| S3 | 55.7 | 75.6 | 27.0 |
| S2 | 55.8 | 180.1 | 25.6 |
| N2 | 54.5 | 211.5 | 17.6 |
| S1 | 57.3 | 247.0 | 30.9 |
| N1 | 95.0 | 303.2 | 43.3 |

The development roller 4M and the doctor blade 25M are adjusted to have a gap therebetween and are fixed to the projecting portion 16M, by a bearing 27M that is made of an appropriate resin material such as polyacetal (POM). The gap between the development roller 4M and the doctor blade 25M is experimentally obtained depending on the amount of the developer transported per unit area with a magnetic brush on the development sleeve 26M. In the present embodiment, the gap between the development roller 4M and the doctor blade 25M may be 0.2 mm, and a non-magnetic shaft having a circular cross section (SUS303, having an outer diameter of 5 mm) may be used as the doctor blade 25M in order to suppress the deterioration of the developer in this gap. Here, a length of the magnetic brush in a position of a main pole of the development sleeve 26M may be about 800 μm.

An outer diameter of the development roller 4M may be 14 mm. The development sleeve 26M serving a part of the development roller 4M rotates in a direction opposite to the rotating direction of the photosensitive drum 1M, and in a position facing the photosensitive drum 1M, it moves in the same direction as the moving direction of the photosensitive drum 1M at an appropriate peripheral velocity ratio such as 1.35 with respect to the photosensitive drum 1M. That is, the development sleeve 26M rotates at an appropriate peripheral velocity such as 202.5 mm/s. The development roller 4M and the photosensitive drum 1M are arranged so as to face each other, and a gap between the development roller 4M and the photosensitive drum 1M can be adjusted by changing a diameter of gap rollers 18M that are disposed at both ends of the development roller 4M, as shown in FIGS. 3 and 5. This gap is experimentally obtained depending on the image density, the adhesion of the carrier to the photosensitive drum 1M and the like. In the present embodiment, this gap may be set to be 0.4 mm. Moreover, an angle θ between: a line connecting the shaft center (the rotational center line) of the photosensitive drum 1M and the shaft center (the rotational center line) of the development roller 4M; and a horizontal line passing through the shaft center (the rotational center line) of the photosensitive drum 1M may be set to be 61.25°, depending on the positional relationship with the above-described adjacent image forming unit.

As shown in FIGS. 1 to 4, in a first developer transport path 14M that is positioned above the partition wall 13M of the developing apparatus 8M, a first developer transporting screw 17M (a first developer transporter) that extends in an axial direction of the development roller 4M is provided. And, in a second developer transport path 15M that is positioned below the partition wall 13M of the developing apparatus 8M, a second developer transporting screw 19M (a second developer transporter) that similarly extends in the axial direction of the development roller 4M is provided. Each of the first developer transporting screw 17M and the second developer transporting screw 19M is provided with a spiral vane. As mentioned above, the development roller 4M is disposed above the cleaning blade 3Y of the upstream adjacently positioned photosensitive drum 1Y. Thus, the cleaning blade 3Y of the upstream adjacently positioned photosensitive drum 1Y is positioned below and close to the development roller 4M, and the second developer transporting screw 19M cannot be disposed in this position. The second developer transporting screw 19M is disposed so that a rotation shaft thereof may be positioned above a rotation shaft of the development roller 4M (the development sleeve 26M). Therefore, the detaching region P (a midpoint between the pair of magnets of south poles) for detaching the developer, after development, from the development sleeve 26M, in which the pair of magnets of south poles are disposed, is also positioned above the rotation shaft of the development roller 4M (the development sleeve 26M).

As shown in FIGS. 3 and 4, a shape of the spiral vane (with respect to a winding direction) and a rotating direction of each of the first developer transporting screw 17M in the first developer transport path 14M and the second developer transporting screw 19M in the second developer transport path 15M are set, so that the developer transporting screws 17M and 19M respectively may transport a developer in directions that are opposite to each other, along the axial direction of the development roller 4M. More specifically, the shape and the rotating direction of the spiral vane of the first developer transporting screw 17M are set so as to stir and transport a developer in the direction of the arrow X shown in FIG. 4 (the first developer transport direction), and the shape and the rotating direction of the spiral vane of the second developer transporting screw 19M are set so as to stir and transport a developer in the direction of the arrow Y shown in FIG. 4 (the second developer transport direction).

The first developer transporting screw 17M and the second developer transporting screw 19M with the above-described configurations are basically configured so that developer transporting forces imparted by their spiral vanes may be substantially equal, for achieving smooth stirring transportation and circulation of the developer.

In addition, considering functions of each screw, such as a mixing and stirring property of the developer, which is required for the first developer transporting screw 17M; and prompt replaceablity of the developer, after development, with a new developer, which is required for the second developer transporting screw 19M, the spiral vanes of both screws are configured to have different sizes (outer diameters in the present embodiment) and rotating speeds so that a transporting speed (V2) of a developer by the second developer transporting screw 19M may be higher than a transporting speed (V1) of a developer by the first developer transporting screw 17M.

More specifically, by setting the size (the outer diameter) of the spiral vane of the second developer transporting screw 19M to be smaller than the size (the outer diameter) of the spiral vane of the first developer transporting screw 17M, and the rotating speed of the second developer transporting screw 19M to be higher than the rotating speed of the first developer transporting screw 17M, only the transporting speed of the developer by both screws may be different from each other, without different amounts of the developer being transported by both screws. The rotating speeds of the first developer transporting screw 17M and the second developer transporting screw 19M are determined by setting a gear ratio of gear trains between these screws and a driver. In this case, the sizes of the spiral vanes and the rotating speeds of the developer transporting screws may be set arbitrarily, as long as the above-described functions can be attained. However, if the rotating speed of the second developer transporting screw 19M is set to be excessively high, a stress is applied to the developer, and thus it is preferable to set the rotating speed of the second developer transporting screw 19M to be in an appropriate range such as from about 1.1 times to about 2.0 times the rotating speed of the first developer transporting screw 17M.

In the present embodiment, the outer diameter of the spiral vane of the first developer transporting screw 17M is set to have an appropriate value such as 15 mm, the outer diameter of the spiral vane of the second developer transporting screw 19M is set to have an appropriate value such as 12 mm, and a shaft diameter of the rotation shaft and a pitch between the spiral vanes of each screw are set to have appropriate values, such as 5 mm and 25 mm, respectively. Moreover, the rotating speed of the second developer transporting screw 19M is set to have an appropriate magnitude such as 1.66 times the rotating speed of the first developer transporting screw 17M. The specific numeric values of the rotating speeds will be described below.

As mentioned above, by transporting the developer in the direction of the arrow X shown in FIG. 4, and mixing and stirring the toner and the carrier for a sufficient period of time, while slowly rotating the first developer transporting screw 17M to which a toner is newly supplied, an appropriate and uniform toner density can be obtained, and the sufficiently electrified toner can be supplied to the second developer transporting screw 19M. In particular, in the case of using an emulsion polymerization toner that requires time for electrification because of the difficulty of adding a charge control agent, this method is effective. Further, in the second developer transporting screw 19M, by increasing the transport speed of the developer, the developer on the surface of the development sleeve 26M, having a decreased toner density due to the development, can be swiftly mixed and stirred with the other developer that is present in the second developer transport path 15M, and can be transported to a drawing-up region (described below) that is provided at the end of the second developer transporting screw 19M at a higher transporting speed. As a result, the developer, after development, can be swiftly replaced with the developer that is supplied from the first developer transporting screw 17M and has an appropriate toner density and an appropriate electric charge.

In addition, as shown in FIG. 4, at both longitudinal ends of the developing apparatus 8M, communicating holes 20M and 21M that communicate between the first developer transport path 14M and the second developer transport path 15M are formed. The communicating hole 20M that is positioned at a tip portion of the first developer transporting screw 17M on a downstream side of a developer transport direction (the direction of the arrow X) is an opening with an appropriate size formed on the partition wall 13M. In the present embodiment, the opening of the communicating hole 20M is set to have an appropriate size such as 6.5 mm width×20 mm length. The developer that is stirred and transported to the communicating hole 20M by the first developer transporting screw 17M falls by gravity, from the first developer transport path 14M into the second developer transport path 15M through the communicating hole 20M.

The communicating hole 21M that is positioned at a tip portion of the second developer transporting screw 19M on a downstream side of a developer transport direction (the direction of the arrow Y) also is an opening with an appropriate size formed on the partition wall 13M. In the present embodiment, the opening of the communicating hole 21M is set to have an appropriate size such as 10 mm width×20 mm length. Above the communicating hole 21M, a magnet roller 22M (a developer drawing-up unit) is provided. This magnet roller 22M is connected to an end of the first developer transporting screw 17M so that a shaft of the magnet roller 22M may be the same as the rotation shaft of the first developer transporting screw 17M. An outer diameter of the magnet roller 22M is substantially equal to the outer diameter of the first developer transporting screw 17M. The magnet roller 22M rotates together with the first developer transporting screw 17M in the same directions, by which the developer in the second developer transport path 15M can be brought up into the first developer transport path 14M with the magnet roller 22M serving as a form of a magnetic brush. In order to prevent clogging and overflowing of the developer at an end of the second developer transport path 15M, and unevenness of the image density on an edge of an image region, deterioration of the developer and the like that are caused thereby, it is preferable to set a developer drawing-up capability of the magnet roller 22M (an amount of the developer drawn up per unit time by the magnet roller 22M from the second developer transport path 15M into the first developer transport path 14M) to be not less than a developer transporting capability of the second developer transporting screw 19M (an amount of the developer transported per unit time by the second developer transporting screw 19M in the direction of the arrow Y). In the present embodiment, for example, a rubber magnet roller having an appropriate outer diameter such as 15 mm and an appropriate length such as 18 mm that can be obtained by: mixing a powder of barium ferrite with a rubber material such as a nitrile rubber; forming it in a roller shape; and magnetizing it to provide four magnetic poles (N, S, N, S) of north poles and south poles with the same magnetic force (65 mT) alternately at intervals of approximately 90° can be used as the magnet roller 22M. Since this magnet roller 22M is provided with the two north poles and two south poles alternately, a region where a magnetic force is 0 mT does not exist, the magnetic brush of the developer is formed to be long in each region where the north pole or the south pole is magnetized, and the magnetic brush of the developer is formed to be short in each region in the middle between the north pole and the south pole. Thus, a drawing-up force (a transporting force) of the developer by the magnet roller 22M can be increased. Moreover, magnetic members (not shown) in, for example, a SUS 430 group or the like with an outer diameter of 15 mm and a thickness of 0.5 mm are respectively attached to end faces of the magnet roller 22M, thereby preventing the developer from adhering to the both end faces of the magnet roller 22M, and preventing clogging and stagnation of the developer caused thereby. In addition, the amount of the developer drawn up per unit time by the magnet roller 22M will be described below, together with the amount of the developer transported per unit time by the second developer transporting screw 19M.

Furthermore, as shown in FIGS. 5, 6A and 6B, a scraper 28M is provided close to the surface of the magnet roller 22M, on a downstream side of the rotating direction of the magnet roller 22M with respect to a position a that is vertically above the magnet roller 22M. The scraper 28M can be formed being combined with the development housing of the same resin material as that of the development housing. In the present embodiment, a gap between the outer circumferential surface of the magnet roller 22M and the scraper 28M is set to have an appropriate value such as 0.5 mm. Moreover, this scraper 28M has an inclined surface 30M that is formed by inclining a horizontal face passing through the shaft center (the rotational center line) 29M of the magnet roller 22M in the direction of the arrow X (the first developer transport direction).

It is preferable to set an angle $\alpha$ of inclination of the inclined surface 30M to be in an appropriate range such as between 10° and 30° inclusive ($10° \leqq \alpha \leqq 30°$), for balancing the amount of the developer that stays temporarily near the magnet roller 22M with the amount of the developer transported by the scraper 28 to the first developer transporting screw 17M. When the angle $\alpha$ of inclination is less than 10°, the force to transport the detached developer in the direction of the arrow X by utilizing the inclined surface 30M is weak, and clogging and overflowing of the developer are more likely to occur in the drawing-up region. On the contrary, when the angle $\alpha$ of inclination is more than 30°, the force to transport the detached developer in the direction of the arrow X by utilizing the inclined surface 30M is strong, and a stirring time of the developer in a developer buffer space (described below) near the magnet roller 22M is short, thus an effect of mixing and stirring the developer in the developer buffer space is small. Herein, this angle $\alpha$ of inclination is experimentally obtained, depending on the conditions such as the amount of the developer drawn up by the magnet roller 22M, the length of the magnet roller 22M, specifications of the developer and the like. In the present embodiment, the angle $\alpha$ of inclination is set to have an appropriate value such as 25°.

Furthermore, as shown in FIGS. 5, 6A and 6B, a space of the first developer transport path 14M that encloses the magnet roller 22M and a part of the first developer transporting screw 17M connected thereto is shaped like a dome, and an area (a cross-sectional open area) of this space is larger than an area (a cross-sectional open area) of a space of the first developer transport path 14M that encloses the remaining part of the first developer transporting screw 17M. Thereby, the developer buffer space where the developer after being drawn up, can temporarily be stored is provided.

Moreover, in order to smoothly draw up the developer by the magnet roller 22M, as shown in FIGS. 2 and 5, a clearance D between: a wall surface connecting the second developer transport path 15M with the first developer transport path 14M; and the outer circumferential surface of the magnet roller 22M is made larger than a clearance between: the outer circumferential surface of the first developer transporting screw 17M; and a wall surface that is close to and around it. This clearance D can be arbitrarily determined, as long as it can satisfy the above-described relationship between: the developer transporting capability of the second developer transporting screw 19M; and the developer drawing-up capability of the magnet roller 22M. In the present embodiment, this clearance D is set to have an appropriate value such as 3.5 mm.

According to the above-described configuration, the developer is drawn up and circulated smoothly between: the first developer transport path 14M positioned above the partition wall 13M; and the second developer transport path 15M positioned below the partition wall 13M. This configuration is effective in preventing the accumulation and the clogging of the developer at the end of the second developer transporting screw 19M positioned below the magnet roller 22M (the developer drawing-up unit), the unevenness of the image density, the deterioration of the developer and the like that are caused thereby.

Moreover, as shown in FIG. 5, in the first developer transport path 14M, a toner density sensor 23M that detects a toner density in the developer by a magnetic permeability of the developer is provided. Thus, when the toner density is decreased by printing, an additional toner is replenished from a toner replenishing port 24M so as to maintain the toner density of 6%.

The developer in the second developer transport path 15M adheres onto a surface of the rotating development sleeve 26M by a magnetic field from the development roller 4M so as to form a magnetic brush, and is transported to a position where the doctor blade 25M is disposed, while rolling on the surface of the development sleeve 26M. A length of the magnetic brush (i.e., a height of the developer on the sleeve) is adjusted when the magnetic brush passes in front of the doctor blade 25M, and subsequently reaches the development region. Thereafter, only the toner is transferred to the photosensitive drum 1M in accordance with the electrostatic latent image formed on the photosensitive drum 1M, thereby carrying out the development.

The developer after having the toner density decreased by the consumption of the toner for the development is transported to the detaching region P where a pair of the magnets of south poles are provided, in accordance with the rotation of the development sleeve 26M, and is released from a magnetic binding force by the development roller 4M. In addition, the developer is removed and transported by the second developer transporting screw 19M, and subsequently is adjusted to again have the toner density of 6%, while being circulated in the first developer transport path 14M and the second developer transport path 15M.

Based on the fact that the developer is detached from the development sleeve 26M using the developing apparatus 8M with the above-described configuration, by utilizing the removing and transporting effect by the second developer transporting screw 19M that is positioned close to the detaching region P, an evaluation of a ghost was performed, where an amount M0 of the developer transported per unit time by the second developer transporting screw 19M in the direction of the arrow Y was utilized as a parameter. At the same time, the unevenness in density between the left part and the right part of the image region was also evaluated.

While performing these evaluations, the amount M0 of the developer transported by the second developer transporting screw 19M in the direction of the arrow Y was varied among 5 levels of 5 g/s, 10 g/s, 15 g/s, 20 g/s and 25 g/s. The amount M0 of the developer transported by the second developer transporting screw 19M in the direction of the arrow Y was varied by changing the rotating speed of the second developer transporting screw 19M, and an amount of the developer that fell per unit time from the communicating hole 20M formed on the downstream side of the first developer transport path 14M was measured. The communicating hole 20M was blocked by using an appropriate means such as a tape, when the amount of the developer transported was not measured. Moreover, the first developer transporting screw 17M was configured to rotate in synchronization with the second developer transporting screw 19M at the same speed. Furthermore, in this evaluation, a center distance d between the second developer transporting screw 19M (a rotational radius r of 6 mm) and the development sleeve 26M (a rotational radius R of 7 mm) was set to have an appropriate value such as 25 mm (=3r+R) that was in a range of Formula 1 below.

$$r+R \leqq d \leqq 3r+R \qquad \text{(Formula 1)}$$

where r denotes a rotational radius of the second developer transporting screw 19M, R denotes a rotational radius of the development sleeve 26M, and d denotes a center distance between the second developer transporting screw 19M and the development sleeve 26M.

The toner used in the experiment was obtained as described below. Firstly, 86 wt % of a polyester resin as a binder resin, 5 wt % of a pigment of each color, 6 wt % of carnauba wax serving as a parting agent, and 3 wt % of a charge control agent made of zinc salicylate were pre-mixed. This mixture was melt-kneaded, roughly pulverized, and then finely pulverized, and the resulting fine particles were graded to obtain non-magnetic toner matrix particles having an average particle size volume of 7.1 μm. After this, 1.0 wt % of hydrophobic silica and 0.5 wt % of hydrophobic titania were added (mixed) as external additives to 98.5 wt % of the toner matrix particles. This toner had a shape factor, an SF value, of 148, which is calculated by Formula 4 set forth below.

Moreover, the carrier used in this experiment was a ferrite carrier that had an average particle size volume of 50 μm, a true specific gravity of 5 g/cm$^3$, volume resistivity of $1\times10^{14}$ Ω·cm in an electric field of 2 kV/cm, and saturation magnetization of 65 Am$^2$/kg in a magnetic field of 79.58 kA/m. Furthermore, a surface of the carrier was coated with a fluorine-modified silicone resin. This carrier had a shape factor, an SF value, of 110, which is calculated by Formula 4 below.

In the present embodiment, 120 g of the developer that contained the toner and the carrier and had a toner density of 6.0% was provided in the developing apparatus 8M. Moreover, when forming a solid-patch electrostatic latent image with 100% of image coverage on the photosensitive drum 1M under the above-described processing conditions by using the image forming apparatus of the present embodiment, a toner amount (hereinafter, called "toner adhering amount") mg0 per unit area that was supplied from the development roller 4M to this electrostatic latent image was $8.0\times10^{-6}$ g/mm$^2$. An image density on a recording sheet measured with a reflection densitometer RD914 manufactured by Macbeth, yielded a sufficient density such as 1.55. In addition, the above-described toner adhering amounts of the colors other than magenta had substantially the same values.

Next, methods for measuring physical properties of the toner and the carrier will be described below in detail.

A shape factor, an SF value, of each of the toner and the carrier was calculated, using an image analyzer, with Formula 4 below based on a projected area (A) and a maximum length (ML) of each particle determined with an optical microscope. Actually, after 500 particles were measured, an average value was obtained.

$$SF \text{ value} = (ML^2/A)\times(\pi/4)\times100 \qquad \text{(Formula 4)}$$

A particle size distribution of the toner was measured using a Coulter Counter (manufactured by Coulter Counter).

Moreover, the particle size distribution of the carrier was measured with a particle size distribution measuring apparatus (LA-920: manufactured by HORIBA, Ltd.) using the principles of laser diffraction/scattering. The particle size of the carrier was measured in a dispersion to which a surfactant, sodium laurylsulfate, was added.

The true specific gravity of the carrier was measured using an air comparison pychnometer manufactured by Beckman. The measurement was performed using a sample amount of 30 g.

Moreover, the carrier resistance was measured using an ultra insulation resistance tester (SM-8210: manufactured by DKK-TOA CORPORATION). In this case, the distance between electrodes was 0.4 mm, and a magnet having a cross-sectional area of 30 mm width×13 mm was attached to an outer portion of each of the electrodes such that the magnets were opposed to each other. The magnetic force inside the electrodes was measured with a gauss meter (HGM8900: manufactured by TOYO JIKI INDUSTRY CO., LTD.), and the magnetic force was 60 mT. After 0.2 g of the carrier was placed between the electrodes, a voltage of 80 V was applied, and the value of resistance was measured 30 seconds later. The volume resistivity was calculated from the electrode area and the distance between the electrodes. The measurement was carried out in an environment at a temperature of 23° C. and a humidity of 50%.

A strength of magnetization of the carrier was measured using a vibrating sample magnetometer (model VSM-P7-15: manufactured by Toei Industry Co., Ltd.). A measurement magnetic field was 79.58 kA/m (1 kOe), and the measurement was carried out in an environment at a temperature of 23° C. and a humidity of 50%.

Next, methods for evaluating the ghost and the unevenness in density between the left part and the right part of the image region will be described below in detail.

The evaluation of the ghost was performed by measuring a difference (an image density difference) ΔIDg between: an image density of a halftone image having 25% image coverage immediately after printing a solid patch having 100% image coverage that had a length of about 33 mm (=14×3.14/1.35) in a subscanning direction, which corresponds to one perimeter of the development sleeve 26M; and an image density of a halftone image having 25% image coverage without any previous printing. In the case where the image density difference ΔIDg measured with a reflection densitometer RD914 manufactured by Macbeth was not more than 0.03, there was no problem in image quality, and the thus obtained value was assumed as a standard for evaluating the ghost.

The evaluation of the unevenness in density between the left part and the right part of the image region was performed by measuring a difference (an image density difference) ΔIDw between: an average value of image densities at three points near a left end of the recording sheet; and an average value of image densities at three points near a right end of the recording sheet, after printing a solid image having 100% image coverage on a whole surface of the recording sheet. The measurement points were positioned at a distance of 20 mm from the left end or the right end of the recording sheet, and at distances of 30 mm, 150 mm and 270 mm from a top end of the recording sheet, respectively. Similarly to the evaluation of the ghost, in the case where the image density difference ΔIDw measured with a reflection densitometer RD914 manufactured by Macbeth was not more than 0.05, there was no problem in image quality, and the thus obtained value was assumed as a standard for evaluating the unevenness in density between the left part and the right part of the image region.

Moreover, considering differences of properties of the toners of the respective colors, both of the ghost and the unevenness in density between the left part and the right part of the image region were evaluated, with respect to each of the colors of yellow, magenta, cyan and black.

Evaluation results obtained by the above-described experiments will be shown in Table 2 below.

TABLE 2

| | M0 (g/s) | | | | |
|---|---|---|---|---|---|
| | 5 | 10 | 15 | 20 | 25 |
| Evaluation of ghost | B | B | A | A | A |
| Evaluation of unevenness of density between left part and right part | B | B | A | A | A |

In above Table 2, the evaluation of the ghost is represented by A and B, where A denotes the case that the image density difference ΔIDg was not more than 0.03, and B denotes the case that the image density difference ΔIDg was more than 0.03, as described above. Similarly, the evaluation of the unevenness in density between the left part and the right part is also represented by A and B, where A denotes the case that the image density difference ΔIDw was not more than 0.05, and B denotes the case that the image density difference ΔIDw was more than 0.05, as described above.

From the above results, it was found that, when the amount M0 of the developer transported by the second developer transporting screw 19M in the direction of the arrow Y was not less than 15 g/s, a uniform image on which no ghost or no unevenness in density between the left part and the right part of the image region was generated could be obtained.

The above results can be explained as follows.

It is thought that the improvement (i.e., decrease) of the ghost resulted from an improvement in removing and transporting the developer near the detaching region P by the second developer transporting screw 19M, which was caused by increasing the amount of the developer transported (i.e. the developer transporting force) by the second developer transporting screw 19M when the second transporting screw 19M was close to the development sleeve 26M. More specifically, it is thought that the ghost was improved by two factors: an improvement of the detachability of the developer, which was caused by the formation of a strong flow of the developer near the detaching region P of the development sleeve 26M; and prevention of the developer from re-adhering to the development sleeve 26M, which was caused by taking the developer that was detached once in the detaching region P into the flow of the developer (by the transporting screw).

Also, it is thought that the unevenness in density between the left part and the right part of the image region is prevented by the swift replacement of the developer that was detached from the development sleeve 26M, with a developer with controlled toner density that was transported from the first developer transporting screw 17M. This is caused by the above-described effect of the strong flow of the developer. More specifically, it is thought that the unevenness in density between the left part and the right part of the image region was prevented, because an inclination of the toner density (the toner density was high on an upstream side of the developer transport direction, and was low on a downstream side thereof) that was generated in the developer transport direction due to the consumption of the toner for the development was suppressed by setting the amount M0 of the developer transported to be a predetermined value or more.

Further experiments were performed on the amount M0 of the developer transported by the second developer transporting screw 19M in the direction of the arrow Y, and it was found that a ratio (mg0×l×v)/M0 of an amount (mg0×l×v) of the toner to be consumed per unit time while printing a solid image on a whole surface with respect to the amount M0 of the developer transported was related to the generation of the ghost and the unevenness in density between the left part and the right part of the image region.

Figure 8:
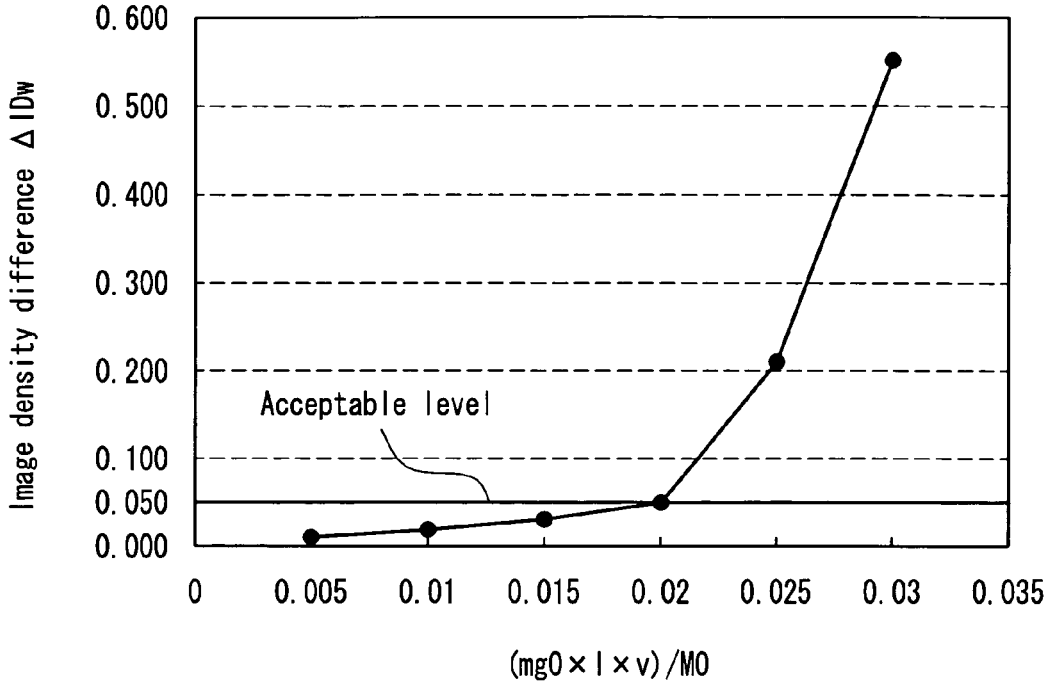
FIG. 8 is a chart showing a relationship between: a ratio ((mg0×l×v)/M0) of an amount (mg0×l×v) of a toner to be consumed per unit time while printing a solid image on a whole surface with respect to an amount M0 of a developer transported; and unevenness in density (an image density difference ΔIDw) between a left part and a right part of an image region, according to Embodiment 1 of the present invention.

FIG. 8 shows a relationship between: the above-described ratio (mg0×l×v)/M0; and the unevenness in density between the left part and the right part of the image region (the above-described image density difference ΔIDw). As shown in FIG. 8, it was found that, when the ratio (mg0×l×v)/M0 was not more than 0.02, the image density difference ΔIDw was not more than 0.05, and the unevenness in density between the left part and the right part of the image region could be prevented. That is, it was found that, when the amount M0 of the developer transported by the second developer transporting screw 19M in the direction of the arrow Y was not less than (mg0×l×v)/0.02 (i.e. M0≧(mg0×l×v)/0.02), the image density difference ΔIDw was not more than 0.05, and the unevenness in density between the left part and the right part of the image region could be prevented.

Figure 9:
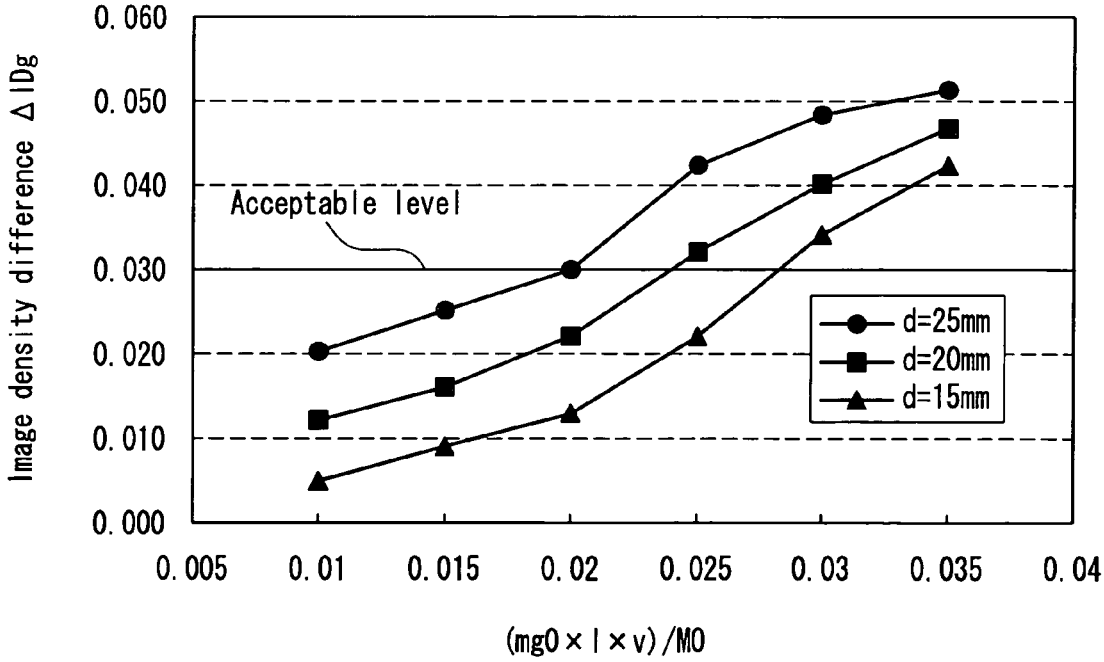
FIG. 9 is a chart showing a relationship between: the ratio ((mg0×l×v)/M0) of the amount (mg0×l×v) of the toner to be consumed per unit time while printing the solid image on the whole surface with respect to the amount M0 of the developer transported; and a ghost (an image density difference ΔIDg), according to Embodiment 1 of the present invention.

FIG. 9 shows a relationship between: the above-described ratio (mg0×l×v)/M0; and the ghost (the above-described image density difference ΔIDg). In the evaluation of the ghost, in order to ensure the effect of removing and transporting the developer near the detaching region P in accordance with a center distance d between: the second developer transporting screw 19M (the rotational radius r of 6 mm); and the development sleeve 26M (the development roller 4M) (the rotational radius R of 7 mm), the center distance d was varied among three levels of 15.0 mm, 20.0 mm and 25.0 mm in the range of Formula 1 above, thereby examining a relationship between the center distances d and the ghost (the above-described image density difference ΔIDg). As shown in FIG. 9, since the effect of removing and transporting the developer near the detaching region P was increased as the center distance d was decreased, by at least setting the ratio (mg0×l×v)/M0 to be not more than 0.02, the image density difference ΔIDg can be suppressed to be not more than 0.03 in the range of the center distance d represented by Formula 1 above. That is, in the case where the center distance d is in the range of Formula 1 above, when the amount M0 of the developer transported by the second developer transporting screw 19M in the direction of the arrow Y is not less than (mg0×l×v)/0.02 (i.e. M0≧(mg0×l×v)/0.02), the image density difference ΔIDg is not more than 0.03, thereby improving the ghost.

From the above-described results, in the present embodiment, it is found that, to not generate the ghost and unevenness in density between the left part and the right part of the image region, the amount M0 of the developer transported must satisfy the Formula 2 below.

$$M0 \geqq (mg0 \times l \times v)/0.02 \quad \text{(Formula 2)}$$

Then, in the present embodiment, the center distance d between the second developer transporting screw 19M and the development sleeve 26M was set to have an appropriate value such as 25 mm, and the rotating speed of the second developer transporting screw 19M was adjusted, whereby the amount M0 of the developer transported in the direction of the arrow Y was set to have an appropriate value such as 12 g/s. Herein, the rotating speed of the second developer transporting screw 19M was 265 rpm, and the rotating speed of the first developer transporting screw 17M was about 160 rpm (=265/1.66).

Moreover, at this time, while the developer transporting force of each of the first developer transporting screw 17M and the second developer transporting screw 19M was 12 g/s, the developer transporting force of the magnet roller 22M was 18 g/s. That is, the developer transporting force of the magnet roller 22M was greater than the developer transporting forces of the first developer transporting screw 17M and the second developer transporting screw 19M, and thus the developer that was transported to the drawing-up region by the second developer transporting screw 19M could be drawn up to the first developer transporting screw 17M without stagnation or delay.

In the present embodiment, a developing apparatus 8M with a configuration where the pair of the developer transporting screws were disposed above and below each other, and the developer was circulated in a direction perpendicular to a longitudinal direction of the developer transporting screws was used as a nonlimiting example for explanation, but a developing apparatus with a configuration where the pair of the developer transporting screws are disposed horizontally, and the developer is circulated in a horizontal direction (the longitudinal direction of the developer transporting screws) may also be used.

Moreover, in the present embodiment, by setting the rotating speed of the second developer transporting screw 19M to be higher than the rotating speed of the first developer transporting screw 17M, the transporting speed of the developer by the second developer transporting screw 19M was set to be higher than the transporting speed of the developer by the first developer transporting screw 17M. However, by structures, configurations and methods other than this, for example, by changing a pitch between the spiral vanes of each screw, a similar effect can also be obtained.

Furthermore, in the present embodiment, the tandem type (one-pass type) color image forming apparatus in which the image forming units of the four colors are disposed in parallel was employed as a nonlimiting example for explanation. However, a four-pass type color image forming apparatus in which the developing apparatuses of four colors are positioned to cooperate with one photoreceptor, having a configuration where the detaching region in which the developer transporting screws and the pair of magnets of the same polarity are disposed is positioned above the rotation shaft of the development roller (the development sleeve), and a monochrome image forming apparatus may also be used. In other words, the features of the present invention are also of benefit and provide advantages in these, as well as other, types of image forming apparatuses.

Moreover, in the present embodiment, as the photoreceptor, the organic layered photoreceptor having negative charge polarity was used, but a single-layer organic photoreceptor in which a charge transport layer and a charge generation layer are formed into one layer, a photoreceptor using an a-Si material or the like may be used, and the charge polarity of the photoreceptor may be either negative or positive. In addition, a shape of the photoreceptor is not limited to the drum, but may be a belt.

Furthermore, in the present embodiment, as the method for electrifying the photosensitive drum 1M, the method of applying the DC voltage to the electrifying roller 5M made of an epichlorhydrin rubber was used, but a method of applying an AC voltage of a sine wave or a rectangular wave may also be used. As a material of the electrifying roller 5M, besides an epichlorhydrin rubber, a urethane rubber, a silicone rubber, an NBR rubber, an acrylic rubber, a fluorine rubber and the like can be used, and it is also possible to perform surface treatments such as surface coating, as necessary. Moreover, as the method for electrifying the photosensitive drum 1M, a scorotron method using a wire and a grid, and a method of using a solid state charging device, which have been often used conventionally, may also be used.

Moreover, in the present embodiment, the number of the magnets disposed in the development roller 4M was seven, but is not limited to this, and a plurality of the magnets may be utilized. Moreover, in the present embodiment, a development sleeve 26M made of aluminum was used, but a development sleeve made of other non-magnetic material may also be used. Furthermore, the development sleeve 26M with the surface roughness Rz of 5 μm was used, but the surface roughness Rz of the development sleeve 26M is not limited to 5 μm. However, in terms of the uniformity of the image and the transporting performance of the developer, it is preferable to use the development sleeve with the surface roughness Rz ranging from 3 μm to 15 μm.

Moreover, in the present embodiment, the development sleeve 26M was configured so as to rotate in a direction opposite to the rotating direction of the photosensitive drum 1M, and move in the same direction as the moving direction of the photosensitive drum 1M at a position facing the photosensitive drum 1M, but the present invention is not necessarily limited to this configuration. The development sleeve 26M may also be configured so as to rotate in the same direction as the rotating direction of the photosensitive drum 1M, and move in the direction opposite to the moving direction of the photosensitive drum 1M at a position facing the photosensitive drum 1M. Furthermore, the peripheral velocity ratio of the development sleeve 26M with respect to the photosensitive drum 1M is not limited to 1.35. The outer diameters of the development roller 4M, the first developer transporting screw 17M and the second developer transporting screw 19M, the shaft diameter of the rotation shaft and the pitch between the spiral vanes of each developer transporting screw, and the rotating speed of each developer transporting screw are not limited to the above-described values, which are utilized merely as nonlimiting examples.

Furthermore, in the present embodiment, as the doctor blade 25M, a non-magnetic shaft having a circular cross section was used, but depending on conditions such as the specifications (or composition) of the developer, specified service life, and the arrangement of the magnets in the development roller 4M, a non-magnetic flat blade, a magnetic shaft having a circular cross section, a magnetic flat blade, a laminate obtained by superimposing a magnetic flat blade and a non-magnetic flat blade or the like may be used as the doctor blade.

Moreover, in the present embodiment, as the magnet roller 22M, the rubber magnet roller that was obtained by mixing barium ferrite powder in the rubber material such as a nitrile rubber, and forming it in the roller shape was used. However, it is also possible to use a plastic magnet roller in which a synthetic resin such as nylon is combined (with e.g., barium ferrite powder) instead of the rubber material such as a nitrile rubber. Furthermore, it is also possible to use a magnet roller having a non-magnetic sleeve made of aluminum or the like in which a plurality of magnetic poles such as plastic magnets or the like are provided. When using the magnet roller having the sleeve in which a plurality of magnetic poles are provided, either a configuration where the sleeve is fixed and the internal magnetic poles are rotated, a configuration where the internal magnetic poles are fixed and the sleeve is rotated, or a configuration where both of the sleeve and the internal magnetic poles are rotated can be utilized.

Moreover, in the present embodiment, as the magnet roller 22M, a magnet roller that was obtained by magnetizing to provide four magnetic poles (N, S, N, S) with a magnetic force of 65 mT alternately positioned at intervals of approximately 90° was used. However, as long as the developer drawing-up capability of the magnet roller 22M is not less than the developer transporting capabilities of the first developer transporting screw 17M and the second developer transporting screw 19M, a magnet roller having the different number of magnetic poles, a different magnetic force, or a different arrangement of the magnetic poles may be used.

Moreover, although the magnet roller 22M was configured to be connected to the end of the first developer transporting screw 17M and to be rotated with the first developer transporting screw 17M, the magnet roller 22M may be configured to be rotated independently of the first developer transporting screw 17M.

Moreover, in the present embodiment, the configuration where the scraper 28M was combined with the development housing was used as a nonlimiting example for explanation, but the scraper 28M may be fabricated as a separate member and attached to the development housing.

Moreover, although the scraper 28M was made of the same resin material as the development housing, the scraper 28M may be formed as a rubber member made of a urethane rubber or the like, or a metal member made of aluminum, stainless steel or the like.

Moreover, although the scraper 28M was disposed close to the magnet roller 22M, the scraper 28M may be disposed in contact with the magnet roller 22M. If the scraper 28M is disposed in contact with the magnet roller 22M as described above, the developer that is held on the surface of the magnet roller 22M can be detached more reliably, and the efficiency of drawing up the developer can be increased. However, in this case, the driving torque of the magnet roller 22M increases, and in addition, the scraper 28M and the surface of the magnet roller 22M become susceptible to deterioration due to e.g., wear. Thus, in order to prevent this, it is preferable to use, as the magnet roller 22M, a magnet roller having a metal sleeve in which a plurality of magnetic poles are disposed, and the magnetic poles are rotated while the sleeve is fixed.

Moreover, in the present embodiment, by providing the wall surface connecting the second developer transport path 15M with the first developer transport path 14M spaced from the outer circumferential surface of the magnet roller 22M, the clearance D shown in FIG. 5 is provided. However, by decreasing the outer diameter of the magnet roller 22M or by combining both of these methods (i.e., by providing a space and decreasing a diameter), the clearance D may be provided. In this case, the developer buffer space near the magnet roller 22M can also be enlarged at the same time. However, when decreasing the outer diameter of the magnet roller 22M, since the interval or space between the magnet roller 22M and the second developer transporting screw 19M is increased, the volume of the magnet roller 22M is decreased, and thus the developer transporting force by the magnet roller 22M is weakened. Thus, in the case of decreasing the outer diameter of the magnet roller 22M, it is preferable to adjust the length of the magnet roller 22M and the magnetic force for magnetization, in view of these facts.

Moreover, in the present embodiment, although the polyester resin was used as the binder resin of the toner, it is also possible to use styrene acrylic resins, epoxy resins and the like.

Moreover, in the present embodiment, the pigment of the toner may contain one or more kinds of pigments or dyes selected from the group consisting of: black pigments such as carbon black, iron black, graphite, nigrosine and a metal complex of an azo dye; arylamide acetoacetate monoazo yellow pigments such as C.I. pigments yellow 1, 3, 74, 97 and 98; arylamide acetoacetate disazo yellow pigments such as C.I. pigments yellow 12, 13, 14 and 17; C.I. solvents yellow 19, 77 and 79; C.I. disperse yellow 164; red pigments such as C.I. pigments red 48, 49:1, 53:1, 57, 57:1, 81, 122 and 5; red dyes such as C.I. solvents red 49, 52, 58 and 8; and blue dyes or pigments including phthalocyanine and its derivative, such as C.I. pigment blue 15:3. An amount of the pigment to be added preferably ranges from 3 to 8 parts by weight with respect to 100 parts by weight of the binder resin.

Moreover, in order to electrify the toner, one or more kinds of electrification control agents may be added, if necessary. In this case, about 1 wt % to about 7 wt % of the material can be added, in accordance with whether the toner is to be positively or negatively electrified.

Furthermore, in order to improve the electrification of the toner or the fluidity thereof, microparticles of silica, alumina, titania and the like with an average particle diameter of 5 nm to 200 nm are added. In order to provide hydrophobicity or control the electrification, surfaces of the microparticles can be subjected to a surface treatment with a silane coupling agent, silicone oil and the like, if necessary.

Furthermore, an volume average particle diameter of the toner preferably ranges from 3 μm to 12 μm. If the particle diameter of the toner is too large, it is difficult to achieve a high resolution. If the particle diameter of the toner is too small, the fluidity of the toner is low, and thus the mixing properties of the toner with the carrier is poor.

Moreover, in the present embodiment, the fluorine-modified silicone resin was used as the coating agent for the surface of the carrier. However, from the experiments carried out by the present inventors, it was found that a similar effect can be obtained, in the case of using a fluorine-modified acrylic resin.

Furthermore, the true specific gravity of the carrier is not limited to the above-described value, but for obtaining a higher fluidity, the value can preferably be as small as possible, for example, 4 g/cm$^3$ or less. The volume average particle diameter of the carrier is not also limited to the above-described value, but for obtaining a high image quality, it can preferably be 40 μm or less. The saturation magnetization of the carrier is also preferably as small as possible, for achieving an excellent detachability from the development sleeve 26M and for obtaining a soft magnetic brush. However, the saturation magnetization of the carrier must be determined, considering the splashing of the carrier to the photosensitive drum 1M.

Embodiment 2

Figure 10:
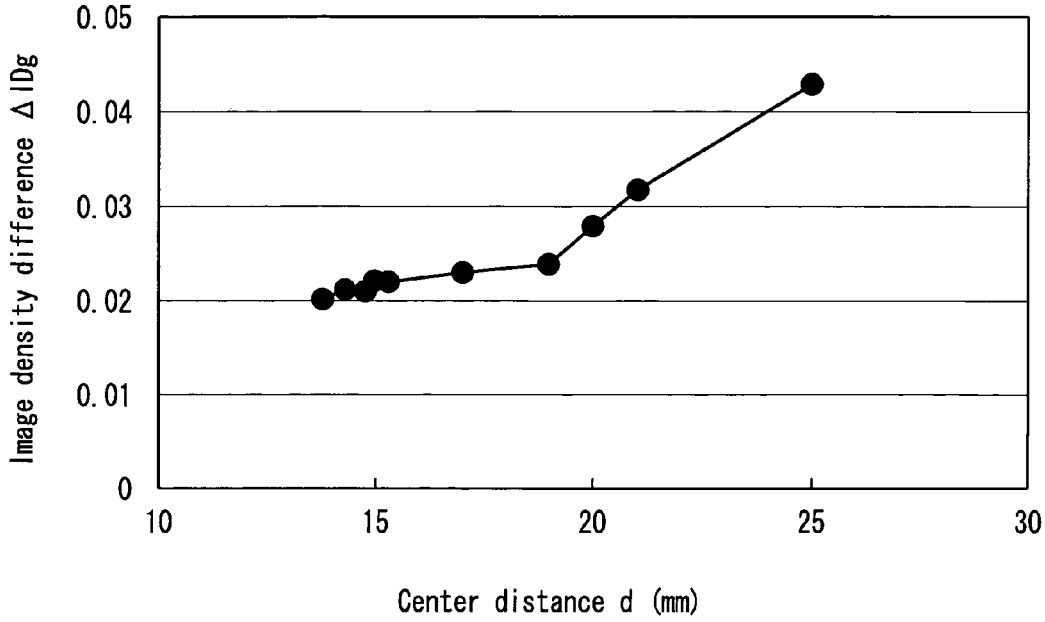
FIG. 10 is a chart showing a relationship between: a center distance d from a second developer transporting screw to a development sleeve; and a ghost (an image density difference ΔIDg), according to Embodiment 2 of the present invention.

Developing apparatuses were manufactured by modifying the developing apparatus of Embodiment 1 so as to have a ratio of (mg0×l×v)/M0 fixed to be 0.025, and center distances d of 13.8 mm, 14.3 mm, 14.8 mm, 15.0 mm, 15.3 mm, 17.0 mm, 19.0 mm, 20.0 mm, 21.0 mm and 25.0 mm, respectively. Then, respective image density differences ΔIDg were measured. FIG. 10 shows the results. As shown in FIG. 10, it is found that, when the center distance d was not more than 2r+R (r=6 mm, R=7 mm, and thus, 2r+R=19 mm), the image density difference ΔIDg was not more than 0.025, and thus the ghost was also improved.

Figure 11:
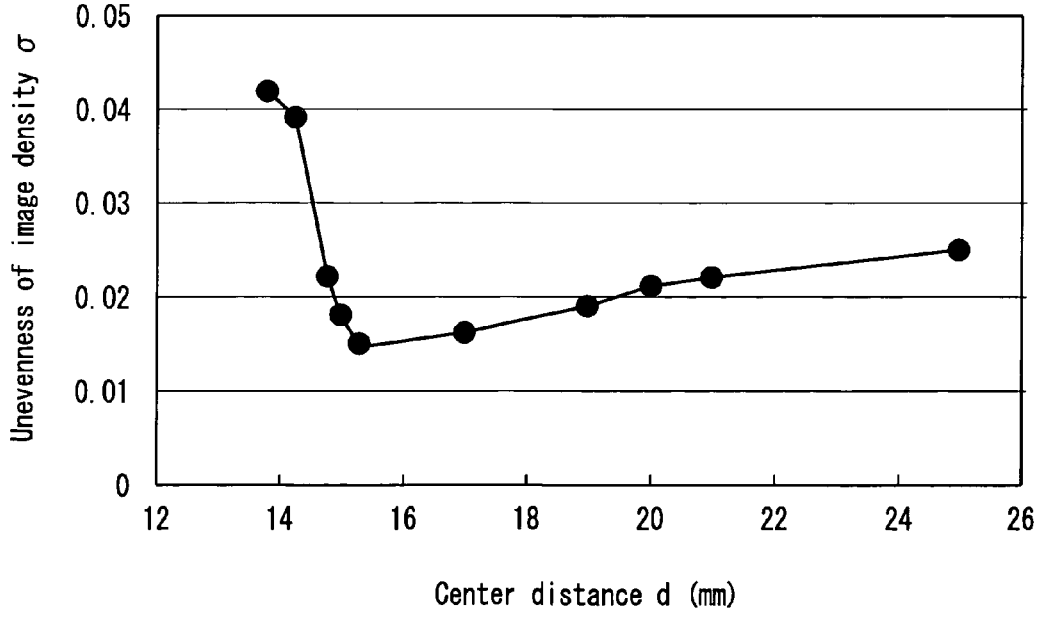
FIG. 11 is a chart showing a relationship between: the center distance d from the second developer transporting screw to the development sleeve; and unevenness a of an image density of a solid image on a whole surface, according to Embodiment 2 of the present invention.

Moreover, by using plural developing apparatuses that were manufactured similarly to the above, unevenness (i.e., variation) a of the image density on a whole solid image was evaluated. The evaluation of the unevenness a of the image density on the whole solid image was performed by measuring a standard deviation of image densities ID at plural measurement points, after printing the solid image having 100% image coverage on a whole surface of a recording sheet. Herein, the measurement points were positioned at distances of 40 mm, 60 mm and 80 mm from the left end or the right end of the recording sheet, and at distances of 30 mm, 90 mm, 150 mm, 210 mm and 270 mm from a top end of the recording sheet, respectively (the total number of the measurement points were 30). FIG. 11 shows the results. As shown in FIG. 11, it is found that, in the case where the center distance d was not less than 14.8 mm, that is, the center distance d was not less than R+1.3r (7+1.3×6=14.8 mm), the unevenness a of the image density was not more than 0.025 and thus was significantly improved.

That is, the center distance d preferably satisfies Formula 3 below.

$$1.3r+R \leqq d \leqq 2r+R \quad \text{(Formula 3)}$$

From the above results, it is thought that unevenness of a pressure applied to the developer by the developer transporting screw could be improved.

Embodiment 3

Figure 12:
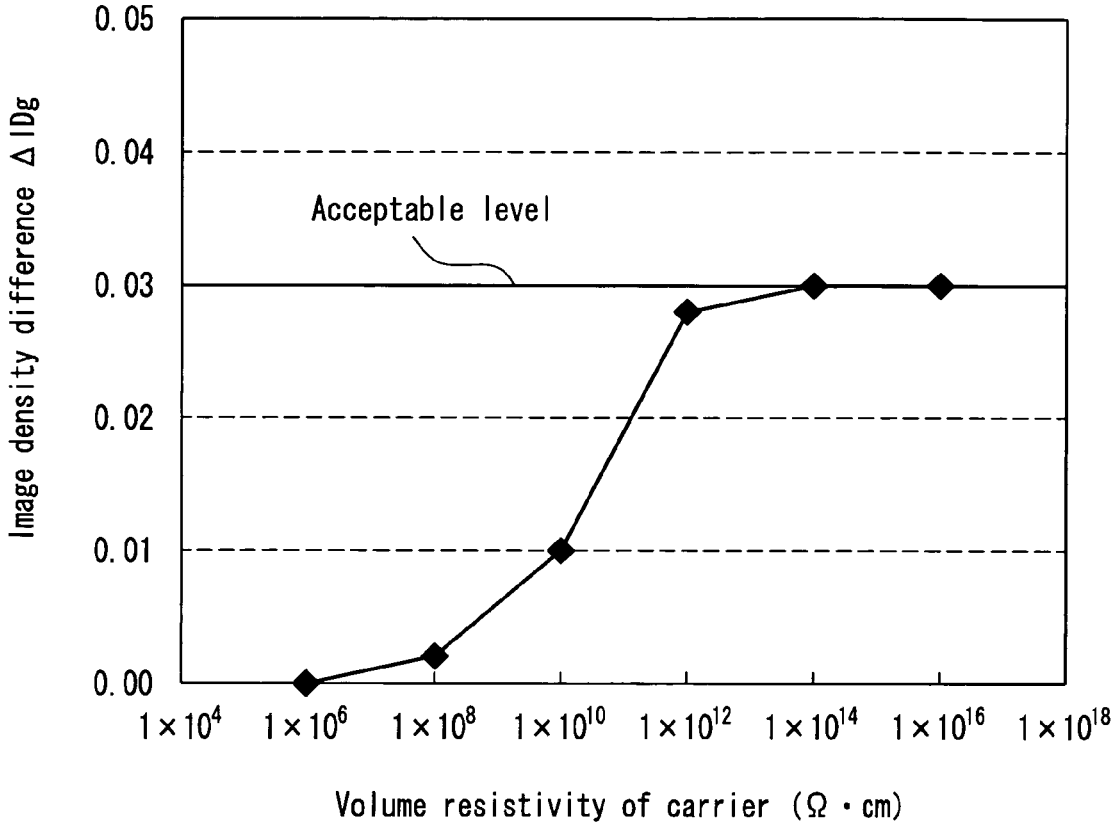
FIG. 12 is a chart showing a relationship between: volume resistivity of a carrier; and a ghost (an image density difference ΔIDg), according to Embodiment 3 of the present invention.

Evaluation of the ghost was performed by varying the volume resistivity of the carrier of Embodiment 1 in the electric field of 2 kV/cm to five levels of $1\times10^6$ Ω·cm, $1\times10^8$ Ω·cm, $1\times10^{10}$ Ω·cm, $1\times10^{12}$ Ω·cm, $1\times10^{14}$ Ω·cm and $1\times10^{16}$ Ω·cm. That is, the image density differences ΔIDg were measured, while varying the volume resistivity of the carrier in the electric field of 2 kV/cm. FIG. 12 shows the results. As shown in FIG. 12, it is found that, when the volume resistivity of the carrier was not more than $1\times10^{10}$ Ω·cm, the image density difference ΔIDg was not more than 0.01, and thus the ghost was further improved. It is also found that, in the measurement with a reflection densitometer RD914 manufactured by Macbeth, the image density difference ΔIDg was substantially zero, and a uniform image could be obtained. This is thought to be because, since electric charge generated by frictional charging with the toner was not accumulated in the carrier, an image force of the carrier applied to the development sleeve was decreased, and the detachability of the developer was improved.

The effect of improving (i.e., decreasing) the unevenness in density between the left part and the right part of the image region was not so significant as the effect of improving the ghost, but the image density difference ΔIDw was decreased. This is thought to be because, since the image forces of the carrier applied to the respective members in the developing apparatus such as the developer transporting screws were decreased, and aggregation and stagnation of the developer near the respective members were prevented, the developer could be transported, mixed and stirred smoothly, and an inclination of a toner density generated in the developer transport direction could be suppressed.

Embodiment 4

In the configuration according to Embodiment 1, a resin carrier used for evaluation was obtained by: dispersing 88 wt % of magnetite with an average particle diameter of 0.2 μm as a ferromagnetic iron compound particle powder in 12 wt % of a thermosetting phenolic resin as the binder resin so as to set the volume average particle diameter to have an appropriate value such as 35 μm. The surface of the particles was coated with a fluorine-modified silicone resin. This carrier had a true specific gravity of 3.7 g/cm$^3$, volume resistivity of $4\times10^8$ Ω·cm in an electric field of 2 kV/cm, and saturation magnetization of 60 Am$^2$/kg in a magnetic field of 79.58 kA/m. Moreover, this carrier had a shape factor, SF value, of 101, and thus it was found to have a substantially spherical shape. Furthermore, this carrier was observed by an electron microscope, and then was found to have a smooth surface with extremely small asperities.

Evaluation of the ghost was performed by using this carrier, and it was found that the image density difference ΔIDg was not more than 0.01, and thus an image with excellent uniformity of the image density could be obtained. This is thought to be because, since the carrier had a substantially spherical shape, and the surface thereof was exceedingly smooth, the fluidity and the detachability of the developer were improved, and thus the detachability of the developer from the development sleeve was also significantly improved.

The effect of improving (i.e., decreasing) the unevenness in density between the left part and the right part of the image region was not so significant as the effect of improving the ghost, but the image density difference ΔIDw was decreased. This is thought to be because, since the fluidity of the developer was improved, the developer could be transported, mixed and stirred smoothly, and the inclination of the toner density generated in the developer transport direction could be suppressed.

In addition, as the thermosetting binder resin of the resin carrier, in addition to phenolic resins, urea resins, melamine resins, polyester resins, epoxy resins and the like can also be used. Thermosetting resins have durability, impact resistance, and heat resistance that are superior to those of thermoplastic resins, and thus a resin carrier containing a magnetic material and a thermosetting resin utilizing these advantages is desirable.

Furthermore, as the ferromagnetic iron compound particle powder, in addition to magnetite, ferromagnetic iron oxide particle powders such as maghemite, spinel ferrite particle powders containing one or more kinds of metals except iron (e.g., Mn, Ni, Zn, Mg, Cu, etc), magnetoplumbite type ferrite particle powders such as barium ferrite, and microparticle powders of iron or iron alloys having an oxide film on surfaces thereof may be used. Among them, ferromagnetic iron oxide particle powders such as magnetite are preferably used. A particle diameter of the ferromagnetic iron compound particles preferably ranges from about 0.02 μm to about 5 μm. A shape thereof may be any of granular, spherical or acicular.

An amount of the magnetic material to be added in the thermosetting resin are preferably in an appropriate range such as from 50 wt % to 90 wt %. When the amount of the magnetic material to be added in the thermosetting resin is more than 90 wt %, it is difficult to disperse the magnetic material in the resin, which may cause a problem in that the magnetic material is likely to be detached or the like. Moreover, when the amount of the magnetic material to be added in the thermosetting resin is less than 50 wt %, a magnetic force of the carrier is small, thus leading to a problem in that the carrier is likely to adhere to a toner holding member.

Furthermore, as the coating agent for the surface of the carrier, besides or as an alternate to, a fluorine-modified silicone resin, a fluorine-modified acrylic resin may also be used.

Embodiment 5

In the configuration according to Embodiment 1, in order to examine a relationship between the shape factor, SF value, of the toner, the ghost and the unevenness in density between the left part and the right part of the image region, toner matrix particles that underwent a pulverizing step and a grading step and that had a shape factor, SF value, of 160 were subjected to a spherical treatment with a suffusing apparatus (manufactured by NIPPON NEUMATIC MFG. CO., LTD) utilizing heat, under five different conditions, i.e., treated at 350° C., 290° C., 230° C., or 200° C., or not treated at all. The shape factors, SF values, of the toner matrix particles that were subjected to the spherical treatment under the respective conditions were 102, 120, 139, 148, and 162, respectively, and experiments were performed by using these toners. Herein, as the carrier, a carrier that is coated with a fluorine-modified silicone resin on a surface thereof was used.

Figure 13:
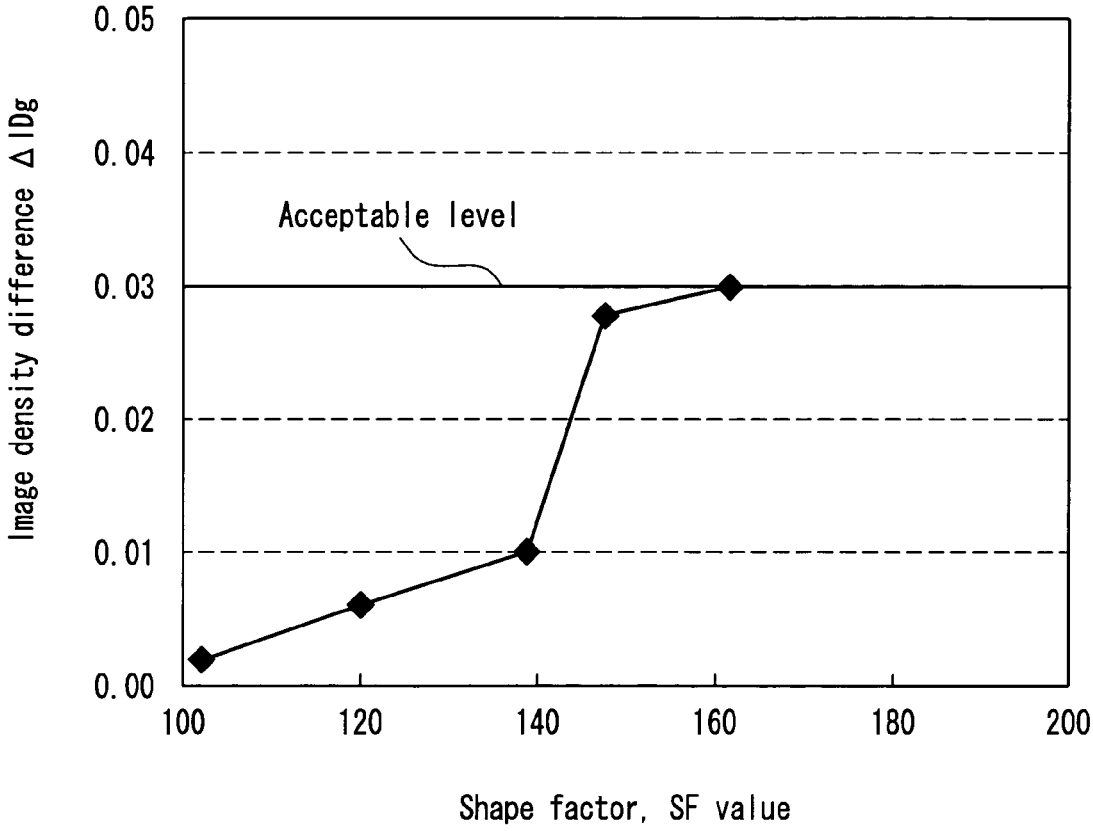
FIG. 13 is a chart showing a relationship between: a shape factor, a SF value, of a toner; and a ghost (an image density difference ΔIDg), according to Embodiment 5 of the present invention.

FIG. 13 shows the relationship between the shape factor, SF value, of the toner, the ghost (the above-described image density difference ΔIDg). As shown in FIG. 13, it is found that, in the case where the shape factor, SF value, of the toner was not more than 140, the image density difference ΔIDg was substantially zero, and thus a uniform image could be obtained. This is thought to be because, by setting the shape factor, SF value, of the toner to be not more than 140, the shape of the toner became close to a spherical shape so as to improve the fluidity of the developer, and the detachability of the developer from the development sleeve was improved.

Whereas, the effect of improving (i.e., decreasing) the unevenness in density between the left part and the right part of the image region was not so significant as the effect of improving the ghost, but the image density difference ΔIDw was decreased. This is thought to be because, since the fluidity of the developer was improved, the developer could be transported, mixed and stirred smoothly, and the inclination of the toner density generated in the developer transport direction could be suppressed.

Figure 14:
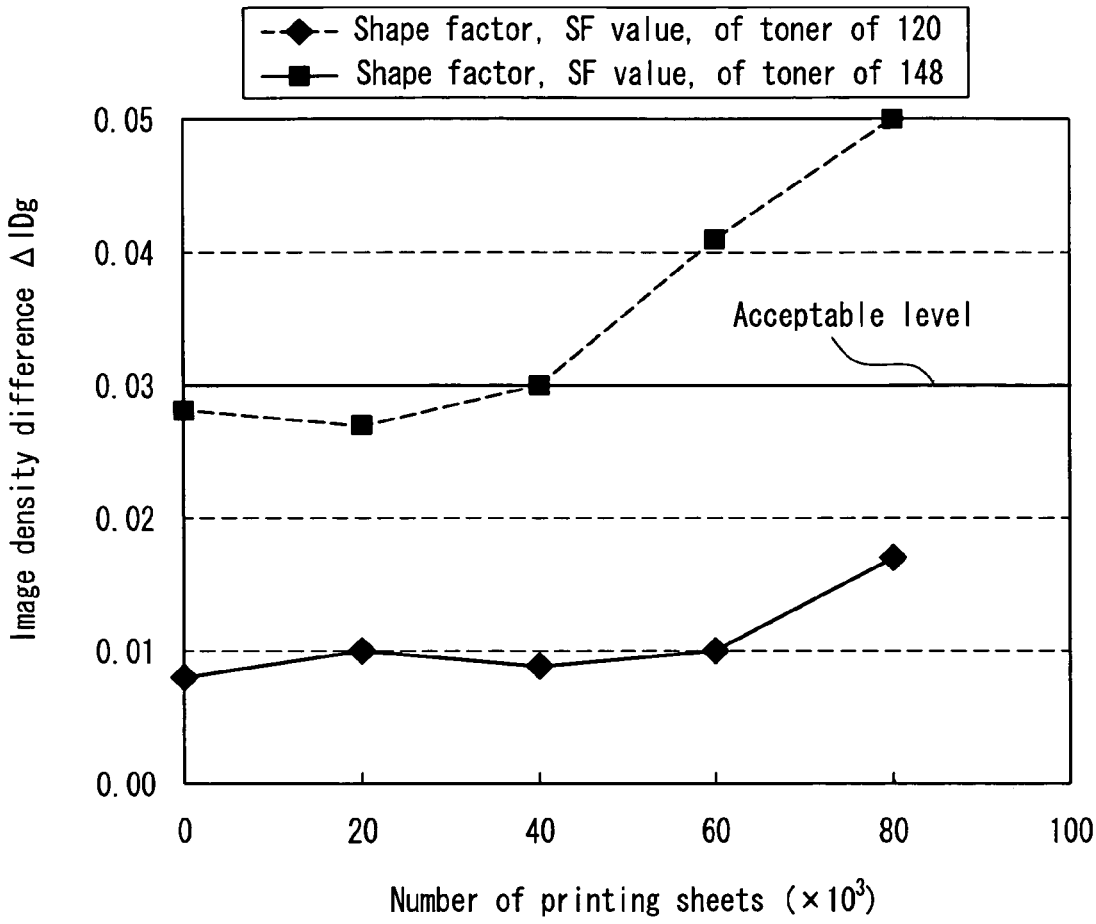
FIG. 14 is a chart showing aging characteristics of the ghost (the image density difference ΔIDg) according to Embodiment 5 of the present invention.

Furthermore, the aging characteristics of the ghost were examined, and the results shown in FIG. 14 were obtained. As shown in FIG. 14, in the case where the shape factor, SF value, of the toner was 148, the image density difference ΔIDg reached 0.04 and generated the ghost after printing $60\times10^3$ sheets. On the contrary, in the case where the shape factor, SF value, of the toner was 120, a uniform image on which the ghost was not generated until printing $80\times10^3$ sheets could be obtained.

This may be caused by the following two factors. The first factor is that, since the fluidity of the developer was improved and the clogging of the developer between the spiral vanes of the developer transporting screw did not occur, favorable removal and transport of the developer could be maintained in the detaching region. The second factor is that, since the shape of the toner was substantially spherical, the peeling of the coating agent of the carrier that was caused by a stress applied to the carrier while stirring the developer did not occur, and the high fluidity and the high detachability of the developer due to the effect of the coating agent could be maintained. Actually, the surface of the carrier after printing $80\times10^3$ sheets was observed by using an electron microscope. When the shape factor, SF value, of the toner was 148, the peeling of the coating agent was significant, on the contrary, in the case where the shape factor, SF value, of the toner was 120, the peeling of the coating agent was hardly observed.

In addition, in the present embodiment, as the method for increasing the sphericity of the toner, a heat treatment was used. However, chemical polymerization methods such as a suspension polymerization method and an emulsion polymerization method also may be used.

Embodiment 6

1.5 wt % of zinc stearate was added as a lubricator to the toner of Embodiment 1, and the evaluations of the ghost and the unevenness in density between the left part and the right part of the image region were performed similarly to Embodiment 1 above.

The evaluation of the ghost was performed by using this toner, and it was found that the image density difference ΔIDg was not more than 0.01, and thus an image with excellent uniformity of the image density could be obtained.

Figure 15:
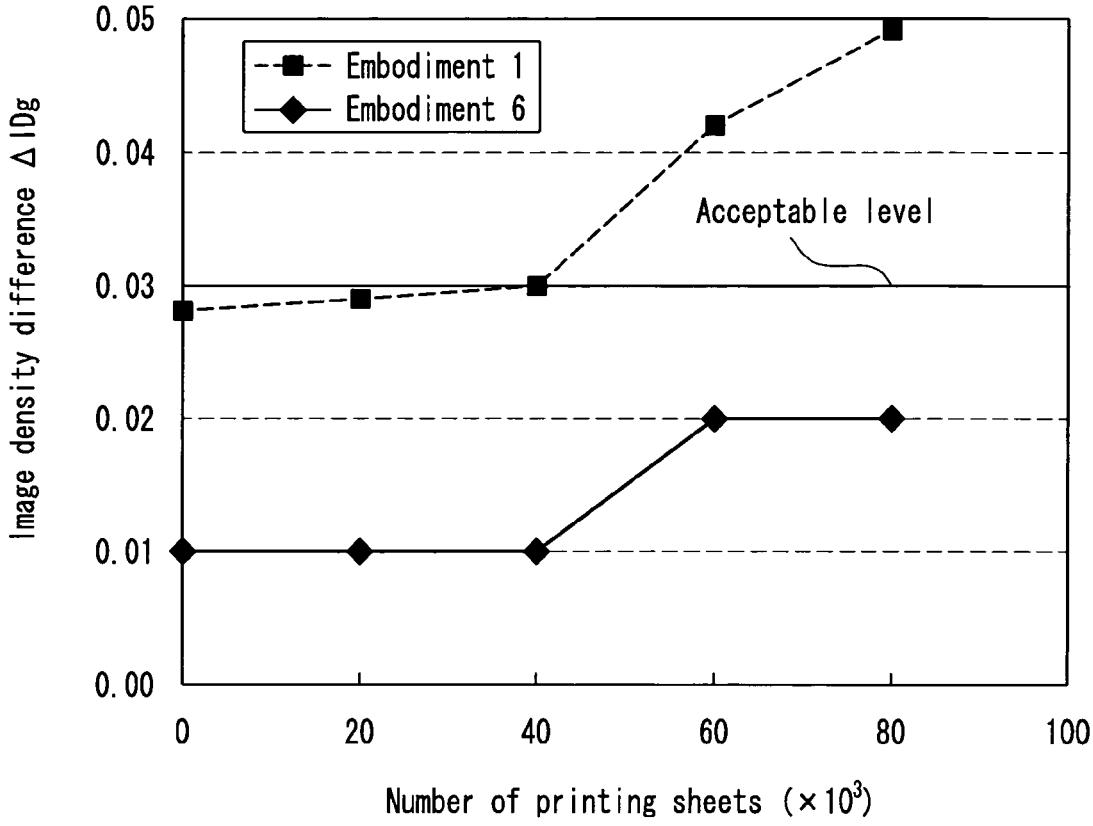
FIG. 15 is a chart showing aging characteristics of a ghost (an image density difference ΔIDg) according to Embodiment 6 of the present invention.

Moreover, the aging characteristics of the ghost in the case of not adding zinc stearate to the toner (above Embodiment 1) and the aging characteristics of the ghost in the case of adding zinc stearate to the toner (present Embodiment 6) were examined, and the results shown in FIG. 15 were obtained. As shown in FIG. 15, in the case of not adding zinc stearate, the image density difference ΔIDg reached 0.04 and generated the ghost after printing $60\times10^3$ sheets. On the contrary, in the case of adding zinc stearate, the image density difference ΔIDg was not more than 0.02 and a uniform image without the generation of the ghost could be obtained, until printing $80\times10^3$ sheets.

It is thought that the above-described results were obtained because, by adding zinc stearate to the toner, the toner functioned as a lubricant, and the fluidity of the developer was improved similarly to the case where the shape factor, SF value, of the toner was small, whereby the detachability of the developer from the development sleeve was improved. Moreover, it is thought that the aging stability of the detachability of the developer (resistance against the generation of the ghost) was caused by the following two factors. The first factor is that the fluidity of the developer was improved, and thus the clogging of the developer between the spiral vanes of the developer transporting screw did not occur. The second factor is that, since the toner functioned as a lubricant, the peeling of the coating agent of the carrier was prevented, and the high fluidity of the developer due to the effect of the coating agent could be maintained over a long period of time.

The effect of improving the unevenness in density between the left part and the right part of the image region was not so significant as the effect of improving the ghost, but the image density difference ΔIDw was decreased. This is thought to be because, since the fluidity of the developer was improved, the developer could be transported, mixed and stirred smoothly, and the inclination of the toner density generated in the developer transport direction could be suppressed.

In the present embodiment, zinc stearate was added in order to enhance the function of the toner as a lubricant. However, the lubricator is not limited to this, and the toner may contain at least one selected from the group consisting of metallic soaps of zinc stearate, calcium stearate, aluminum stearate and magnesium stearate or combination thereof.

The developing apparatus having a small size and employing a vertically circulating system of the present invention can also be applied to electrophotographic image forming apparatuses such as copiers, facsimiles, and printers, as further nonlimiting examples.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its various aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A developing apparatus, comprising:

a rotatable development roller that supplies a two-component developer comprising a toner and a carrier to a rotatable electrostatic latent image bearing member having an electrostatic latent image formed on a surface, and converts the electrostatic latent image into a visible image;

a stationary magnet roller that is provided in the development roller, comprises a development main pole and at least a pair of magnetic poles of the same polarity for detaching the developer, and has a midpoint between the magnetic poles of the same polarity on the development roller that is positioned above a rotation shaft of the development roller;

a first developer transport path and a second developer transport path that extend in parallel to the development roller;

a first developer transporter that is mounted for rotation in the first developer transport path, and transports the two-component developer along a first developer transport direction by rotation; and a second developer transporter that is disposed in the second developer transport path, has a rotation shaft positioned above the rotation shaft of the development roller, transports the two-component developer in a second developer transport direction which is opposite to the first developer transport direction by rotation, supplies the two-component developer to the development roller and detaches the two-component developer from the development roller, wherein a relationship $$r+R \leqq d \leqq 3r+R$$

is satisfied, where r (mm) denotes a rotational radius of the second developer transporter, R (mm) denotes a rotational radius of the development roller, and d (mm) denotes a center distance between the second developer transporter and the development roller, and a relationship $$M0 \geqq (mg0 \times v \times l)/0.02$$

is satisfied, where mg0 (g/mm$^2$) denotes an amount of the toner per unit area that is supplied from the development roller to an electrostatic latent image having 100% image coverage which is provided on the electrostatic latent image bearing member, v (mm/s) denotes a rotational peripheral velocity of the electrostatic latent image bearing member, l (mm) denotes a maximum printing width of the electrostatic latent image bearing member, and M0 (g/s) denotes an amount of the developer transported per unit time by the second developer transporter in the second developer transport direction.

2. The developing apparatus according to claim 1, wherein a relationship of $$1.3r+R \leqq d \leqq 2r+R$$

is satisfied.

3. The developing apparatus according to claim 1, wherein the second developer transport path is disposed below the first developer transport path, the developing apparatus further comprising:

two communicating holes, one at each end of the first developer transport path and the second developer transport path so that the first developer transport path and the second developer transport path communicate with each other; and a developer drawing-up unit provided near one of the communicating holes, and draws up the two-component developer which is transported in the second developer transport path into the first developer transport path.

4. The developing apparatus according to claim 3, wherein an amount of the developer drawn up per unit time by the developer drawing-up unit from the second developer transport path into the first developer transport path is not less than the amount of the developer transported per unit time by the second developer transporter in the second developer transport direction, and a transporting speed of the two-component developer transported by the second developer transporter in the second developer transport direction is more than a transporting speed of the two-component developer transported by the first developer transporter in the first developer transport direction.

5. The developing apparatus according to claim 3, wherein a cross-sectional open area of the first developer transport path enclosing the developer drawing-up unit and the first developer transporter that is positioned in a vicinity of the developer drawing-up unit is larger than a cross-sectional open area of the first developer transport path enclosing the first developer transporter except for the vicinity of the developer drawing-up unit.

6. The developing apparatus according to claim 1, wherein a transporting speed of the two-component developer transported by the second developer transporter in the second developer transport direction is more than a transporting speed of the two-component developer transported by the first developer transporter in the first developer transport direction.

7. The developing apparatus according to claim 1, wherein volume resistivity of the carrier in an electric field of 2 kV/cm is not more than $1\times10^{10}$ Ω·cm.

8. The developing apparatus according to claim 1, wherein the carrier is a resin carrier obtained by dispersing a magnetic material in a thermosetting resin as a binder resin.

9. The developing apparatus according to claim 1, wherein a shape factor, a SF value, of the toner ranges between about 100 and 140 inclusively.

10. The developing apparatus according to claim 1, wherein the toner contains, as a lubricator, at least one selected from the group consisting of metallic soaps of zinc stearate, calcium stearate, aluminum stearate and magnesium stearate.

* * * * *